US011986699B1

(12) United States Patent
Walker et al.

(10) Patent No.: US 11,986,699 B1
(45) Date of Patent: May 21, 2024

(54) SYSTEM AND METHOD FOR ESTIMATING FINAL RESTING POSITION OF GOLF BALLS

(71) Applicant: PGA TOUR, INC., Ponte Vedra Beach, FL (US)

(72) Inventors: Barry Walker, Ponte Vedra Beach, FL (US); Jeremy Craven, Ponte Vedra Beach, FL (US); Jonas Henrik Gredenhag, Ponte Vedra Beach, FL (US); Walter Kenneth Lovell, Ponte Vedra Beach, FL (US); Kevin Kerr, Ponte Vedra Beach, FL (US); Spencer Border, Ponte Vedra Beach, FL (US)

(73) Assignee: PGA TOUR ENTERPRISES, LLC, Ponte Vedra Beach, FL (US)

( * ) Notice: Subject to any disclaimer, the term of this patent is extended or adjusted under 35 U.S.C. 154(b) by 0 days.

(21) Appl. No.: 18/238,234

(22) Filed: Aug. 25, 2023

Related U.S. Application Data

(60) Provisional application No. 63/428,309, filed on Nov. 28, 2022.

(51) Int. Cl.
*A63B 24/00* (2006.01)
*A63B 69/36* (2006.01)

(52) U.S. Cl.
CPC .. *A63B 24/0021* (2013.01); *A63B 2024/0028* (2013.01); *A63B 2024/0037* (2013.01); *A63B 69/3691* (2013.01)

(58) Field of Classification Search
CPC ..... A63B 24/0021; A63B 2024/0025–0053
See application file for complete search history.

(56) References Cited

U.S. PATENT DOCUMENTS

| | | | | |
|---|---|---|---|---|
| 9,460,242 | B2 * | 10/2016 | Kamino | G06F 30/20 |
| 10,478,706 | B2 * | 11/2019 | O'Connor | G01C 11/06 |
| 2007/0167247 | A1 * | 7/2007 | Lindsay | G01S 17/58 473/131 |
| 2009/0036237 | A1 * | 2/2009 | Nipper | A63B 24/0006 473/409 |
| 2012/0238380 | A9 * | 9/2012 | Marty | G06V 40/23 473/407 |
| 2018/0120428 | A1 * | 5/2018 | Tuxen | G01S 13/58 |
| 2020/0164258 | A1 * | 5/2020 | Tuxen | G09B 19/0038 |
| 2021/0220718 | A1 * | 7/2021 | Tuxen | A63B 69/3623 |
| 2022/0138969 | A1 * | 5/2022 | Forsgren | G06V 20/52 382/103 |
| 2022/0219065 | A1 * | 7/2022 | Rankin | A63B 24/0021 |
| 2022/0284628 | A1 * | 9/2022 | Tuxen | G06V 40/50 |
| 2022/0387873 | A1 * | 12/2022 | Hall | A63B 24/0021 |
| 2023/0199295 | A1 * | 6/2023 | Jansson | H04N 23/69 348/46 |

* cited by examiner

*Primary Examiner* — Joshua T Kennedy
(74) *Attorney, Agent, or Firm* — Akerman LLP

(57) ABSTRACT

A system for predicting a resting position of a golf ball may use ball tracking sensor data to identify an impact location of the ball. Modeling of ball movement following impact may be performed that incorporates measured ball impact physics, impact coordinates, and material properties of ground or objects to which the impact coordinates correspond and, together with historical shot data corresponding to the impact coordinates or an encompassing zone, bounce and roll behavior and/or final resting position predictions may be generated.

24 Claims, 8 Drawing Sheets

SYSTEM AND METHOD FOR ESTIMATING FINAL RESTING POSITION OF GOLF BALLS

CROSS-REFERENCE TO RELATED APPLICATIONS

The present application claims priority to U.S. Provisional Patent Application 63/428,309, filed Nov. 28, 2022, the contents of which are hereby incorporated herein in their entirety.

TECHNOLOGY

The present disclosure is related to prediction of bounce and roll behavior and position of a golf ball on a golf course or surrounding area and methods of prediction modeling of the same.

BACKGROUND

The PGA TOUR currently tracks detailed ball location for every shot. For example, prior to every PGA TOUR event each golf course is mapped to create a digital image of each hole that is used as background information in order to calculate exact locations and distances between any two coordinates, e.g., tee box and the player's first shot or the shot location and the location of the hole. Using the mapping data together with its ShotLink system, PGA TOUR collects the location of every ball and scoring for every shot for every round. Using lasers located around the course, laser operators obtain location coordinates corresponding to each ball at rest. As a fallback, personnel may also visually locate a ball at rest and plot the location on a map to obtain location coordinates. The tournament data provided by the ShotLink system has been proven to be invaluable to fans and players alike.

What is needed are improved techniques for determining ball position during tournament play.

SUMMARY

In one aspect, a system for determining final resting position of a golf ball utilizes predicative analytics employing a prediction model that incorporates metadata measured with respect to ball physics and the course environment to predict bounce and roll behavior and/or a final resting position of a ball following impact. The prediction model may take measured ball impact physics, impact coordinates, and material properties of ground or objects to which the impact coordinates correspond and, together with historical shot data corresponding to the impact coordinates or encompassing zone, predict bounce and roll behavior and/or final resting position. Thus, the prediction model may incorporate bounce and roll behavior of the ball using surface properties of the location of a first impact and, in some embodiments, subsequent impact locations, to predict final resting position. In various embodiments, rather than using a computer generated version of a course, the system uses detailed map data that comprises a measured surface model specifying ground and object topography of coordinates of a property, which is used herein to refer to a property that includes a golf course and surrounding areas thereof that may become a location that a ball may find its way into during play. The surface model may comprise a three-dimensional coordinate model, which may comprise a digital surface model measured by lidar, photogrammetry, radar, or other suitable technologies.

In a further aspect, surface model may include detailed mapping of areas that include every or nearly every feature in a property such as the base ground material, grass, grass type, trees, shrubs and other vegetation and surface modeling to an accuracy of 1 inch. Map data used to produce the detailed maps may be collected using technology such as lidar, Laser and photogrammetry carried by remotely piloted or other aircraft as well as by walking or robotic ground-based devices. Zones may be identified within the maps that can be specific or general as needed. For example, green, fringe, fairway, primary rough, secondary rough or other zones. Zones may be used with respect to generating predictions with respect to predicted zones of impact, resting position, or the like.

In one embodiments, the system includes or accesses a historical shot database that maintains an archive of historical shot-based data that demonstrates behavior and location of shots placed in tournament golf to offer a historical record of shot behavior in a variety of conditions that are placed by a variety of players. This historical record may be utilized as a template for prediction of future shots based on physics as well as random variables such as wind direction, velocity and variability, temperature, and pressure.

In some embodiments, detailed data at multiple levels of a golf course during play may be collected by an array of environmental sensors to track changing weather and other environmental conditions. Shot data may be tagged with weather and environmental conditions and stored in the historical shot database for use in modeling the behavior of shots struck as well as other physics elements in natural conditions in the current or future tournaments.

In one embodiment, a coordinate prediction model is utilized that includes a routine that first uses a flight simulator that generates a polynomial estimate of a golf ball's flight path, as measured by radar, lidar, camera or other sources, to predict a first impact location of the ball, e.g., impact coordinates. From there, a physics simulator comprising a prediction model is utilized to predict bounce and roll behavior of the ball from the impact location. The prediction model may incorporate the previously collected detailed mapping data showing the location of natural features as well as man-made elements such as hospitality areas, camera towers and other obstructions, to predict the final resting location of the ball, e.g., resting coordinates. To improve the modeling of bounce and roll physics, a historical sliding window of shots may be used to identify the optimum physics modeling for the next stroke. Filters may be in place to remove outlying data from the historical analysis. To determine the confidence of the zone and predicted location, the predicted resting location of the ball may be analyzed to determine its proximity to other zones. If there is no other zone near the predicted resting ball location, the confidence is high.

BRIEF DESCRIPTION OF THE DRAWINGS

The novel features of the described embodiments are set forth with particularity in the appended claims. The described embodiments, however, both as to organization and manner of operation, may be best understood by reference to the following description, taken in conjunction with the accompanying drawings in which:

DESCRIPTION

Figure 1:
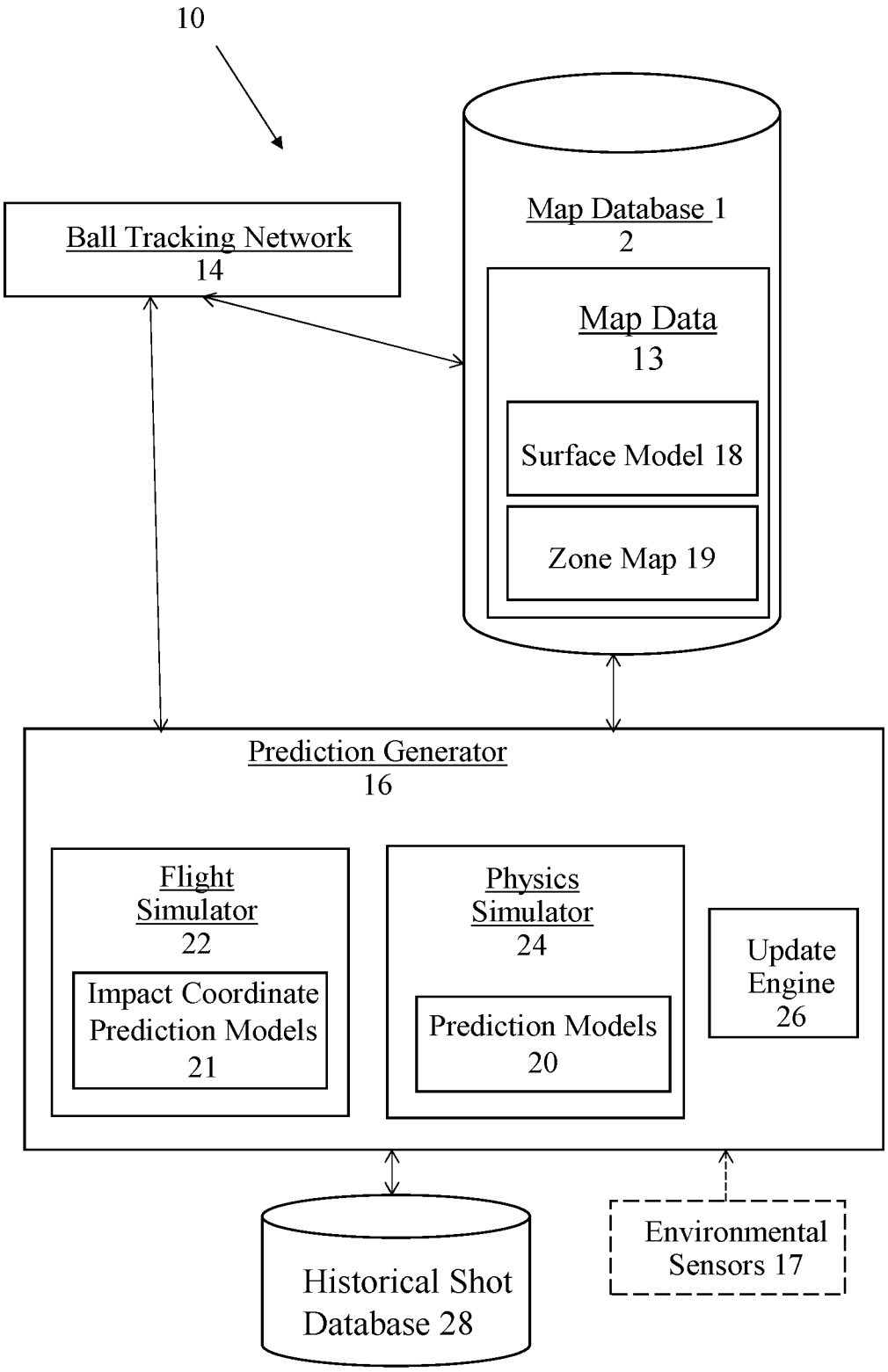
FIG. 1 illustrates an example system configured to predict final resting positions according to various embodiments described herein.

In various embodiments, a system may be used to generate predictions with respect to the location of balls during golf play. The system may be configured to output predicted ball locations corresponding to a final resting position following a hit. In one example, the system is configured to output a predicted bounce and roll model that provides a prediction of the bounce and roll of a ball following impact. For example, using sensor data stroke trail polynomial, the system may be configured to calculate a predicted resting location by simulating bounce and roll from the location of the stroke trail's actual or predicted impact with a surface. The system may include a prediction generator employing one or more prediction models to calculate predicted bounce and roll behavior and/or final resting position or coordinates thereof of a ball following impact. Impact may be ground impact or impact with an object, such as a tree, wall, building, or other object. Predictions may consider various conditions of impact locations, such as topography, material, and properties thereof provided by detailed maps. Predictions models may be updated using data derived from comparison of actual and predicted bounce and roll behavior and/or final resting position.

In various embodiments, the system utilizes predicative analytics employing a coordinate prediction model that incorporates metadata measured by a ball tracking network with respect to ball physics and the course environment to predict bounce and roll behavior and/or a final resting position of a ball following impact. The coordinate prediction model may take measured or predicted ball impact physics and coordinates together with surface features of the impact coordinates, such a surface topography, firmness, or stimp, and historical shot data corresponding to the impact coordinates and/or physics to predict bounce and roll behavior and/or final resting position. Thus, the coordinate prediction model may incorporate bounce and roll behavior of the ball using surface characteristics of the location of a first impact and, in some embodiments, subsequent impact locations. Further to the above, in some examples, rather than using a computer generated version of a course for generating simulated ball behavior, the coordinate prediction model uses detailed map data comprising a measured surface model specifying ground and object topography of coordinates of a property, which is used herein to refer to a property that includes a golf course and surrounding areas thereof that may become a location that a ball may find its way into during play. The surface model may comprise a three-dimensional coordinate model, which may comprise a digital surface model measured by lidar, photogrammetry, radar, and the like. The coordinate prediction model may access the surface model data to simulate bounce and roll behavior and predict a final resting position as described above and elsewhere herein. It is to be appreciated that the system may alternatively utilize detailed maps of a course portion of a property for more limited application to predictive bounce and roll behavior and/or final resting position, e.g., a traditional area of play of a golf course.

The prediction models may incorporate physics, e.g., including actual or predicted ball impact physics variables, ball properties, and librarys of impacted surfaces of ground and/or objects, e.g., firmness, surface topography, stimp, other material properties, or combination thereof. The prediction models may further include one or more associated coefficients that modify prediction model terms, parameters, parameter estimates, or, otherwise, output. In various embodiments, the coordinate prediction model employs polynomial modeling in prediction models to generate predictions with respect to impact location, bounce, roll, or combination thereof. The coefficients may be applied to one or more terms or parameters of a prediction model. In one example, coefficients may include or alter terms, parameters, parameter estimates, or values corresponding to properties of impact materials. In some examples, coefficients include regression coefficients.

According to various embodiments, the system is configured to track balls with sensors of a ball tracking network. The coordinate prediction model may include a flight simulator that receives ball tracking data from the ball tracking network and generates a stroke trail. The ball tracking data and/or stroke trail may be used by the flight simulator to predict or identify a first impact location. The coordinates of the first impact location may be used to identify a zone and obtain a current prediction model corresponding to the zone. The coordinates of the first impact location may be further applied to the surface model to obtain surface topography of the first impact location, which may include surface angle. In some embodiments, surface topography may also include surface dimensions and/or a relative height of the surface. The ball tracking data alone or via the generated stroke trail may be used to generate the impact physics of the ball. The physics simulator may input the impact physics and surface features, e.g., surface topography, into the current prediction model to obtain data that may be used to identify a subsequent impact location and associated impact physics. For example, the output may include values corresponding to direction and distance of subsequent impact locations or values corresponding to bounce or roll characteristics as described herein that may be applied from the first impact location of the coordinate space. In some embodiments, the first impact coordinates may also be input into the prediction model. In one configuration, the output includes a subsequent impact location. Using the output, coordinates for each subsequent impact location from a bounce/roll and corresponding impact physics may be obtained iteratively until no further movement is predicted and final resting position may be identified. In one embodiment, surface topography is used only in the initial impact location calculation or not used at all. In one embodiment, surface topography is used in each impact and roll location. In addition to surface topography, e.g., from the surface model, ground characteristics, e.g., using the detailed map, which may be a zone map, may be used to model the bounce and roll behavior. In one embodiment, surface features such as stimp, material properties, or combination thereof may be used with respect to an initial impact location, subsequent impact location, or combination thereof. In one embodiment, stimp is not used. In one embodiment, stimp or material properties are represented in coefficients of the prediction models.

In one embodiment, prediction models may incorporate stimp data for bounce and roll modeling. Stimp is a measurement of how fast a golf ball rolls on a surface and is a representation of the coefficient of friction of a golf ball rolling on the surface. Higher coefficient of friction corresponds to reduction in speed whereas higher stimp corresponds to increase in speed. Those having skill in the art will appreciate that description of stimp and stimp coefficients described herein may be substituted by various representations of coefficient of friction including coefficient of friction.

In some embodiments, the prediction model may be continuously updated by analyzing a difference between a predicted final resting position. In one example, prediction models may be dynamically calibrated with respect to a firmness coefficient corresponding to firmness of an impacted surface. In some examples, differences in actual and predicted behavior analyzed may include bounce location and/or roll location. In further examples, differences in actual and predicted behavior include one or more bounce characteristics such as bounce number, height, length, acceleration, velocity, inbound angle, outbound angle, direction, or combinations thereof, and/or one or more roll characteristics such as distance, acceleration, max/min velocity, velocity variability, velocity between two or more points, direction, or combination thereof.

Using the examined differences, the prediction model may be updated based on such real world feedback. For example, the model may be refitted or trained based on real world feedback to continuously improve the accuracy of the model. In one configuration, utilizing detailed map data in combination with continuous refitting/training of the prediction model may be used to improve predictive capabilities in a manner that adapts to actual conditions. In one example, the prediction model utilizes a sliding window of shots with respect to the real world feedback to enhance the model to actual conditions. For instance, the prediction model may be enhanced to actual conditions by refitting/training the prediction model to a sliding window of a previous number of shots. In some embodiments, filters may be used to remove outlying data from historical analysis of real world feedback. For example, when a difference in predicted and actual behavior is outside a predetermined range of values, the system may exclude the data. The values may be with respect to one or more behaviors or a combination of behaviors, such as roll, bounce, and/or characteristics thereof identified above.

In various embodiments, a property may be divided into zones and each zone may be associated with one or more coefficients. As introduced above, the coefficients may be applied to one or more terms or parameters of a prediction model. In some embodiments, different prediction models are utilized with respect to different zones or designated locations of the property. In further embodiments, prediction models relative to zones, such as coefficients thereof, are only updated after a ball's bounce and roll and/or final resting position has been predicted and compared to actual data. Thus, updating the prediction model with respect to one zone may not update the prediction model with respect to another zone. This may be the case even when two zones have the same or similar impact material, e.g., grass type. For instance, when a ball impacts a zone of a first hole, the prediction model for that zone may be updated. However, other zones or subzones of the same or different holes may not be similarly updated.

In some embodiments, prediction models incorporate a static stimp coefficient. However, stimp coefficients may also be dynamically calibrated. Dynamic calibration may be performed in a manner similar to that described herein with respect to firmness. For example, predicted roll characteristics, such as speed or distance, may be compared to actual characteristics as measured by sensors. The speed or distance may be used to calculate an optimum stimp coefficient. In some embodiments, stimp coefficients may be updated continuously or periodically, such as upon the occurrence of an event. In one example, stimp coefficients may be updated based on environmental sensor data. For instance, morning dew and rain impact stimp and may evaporate from surfaces as over time and as temperature increases. Accordingly, optical sensors may monitor condensation on grass, rain gauges may be used to estimate soil saturation and moisture accumulation on grass, temperature sensors may measure temperature in order to estimate evaporation, soil saturation sensors may collect data that the system uses to predict surface moisture, or combination thereof.

In some embodiments, the system may also determine a confidence of a predicted resting position and corresponding zone. For example, the system may analyze the predicted resting position to determine proximity to other zones. If the predicted resting position is not within a predetermined proximity from another zone, the system determines that the confidence is high.

In one configuration, the system is configured to calculate a zone probability of the predicted ball at rest. The system may create a distribution of locations around a stroke trail's impact location, each with a probability of occurrence. Ball at rest (i.e., final resting position) predictions may be simulated for each of these locations using multiple firmness levels. For example, in one embodiment, three firmness levels may be used: a current level, a slightly softer level, and a slightly firmer level. This process may include running multiple, such as hundreds, of simulated shots with known parameters and variances and determining a proportion of shots that fall in available zones, for example, in the fairway, rough, bunker or water. The results may be aggregated and summed to determine the probability of outcome of each zone.

With reference to FIGS. 1-8, illustrating various features of the system 10 and methods described herein. The system 10 may be configured to generate predictions with respect to a golf ball after being struck, such as bounce, roll, final resting position, or combination thereof.

With particular reference to FIG. 1, the system 10 configured to predict final resting position according to various embodiments. The system 10 may include or access a map database 12, a ball tracking network 14, and a prediction generator 16.

The map database 12 may include one or more maps or associated map data. For example, the system 10 may include map data of a property. The map data may be employed by the system 10 in various operations. For example, the map data may be used in connection with collection or analysis of historical shot data and/or prediction modeling.

The map data will typically be generated prior to play in which prediction operations of the system 10 are utilized. However, in some instances, map data may be collected or otherwise utilized after play has concluded on a course. For example, map data may be applied to video of shots together with shot physics, when available, to derive historical shot data for use in the operations of the system 10. In a further instance, course conditions and/or environmental variables may also be utilized in such analyses. The system 10 may analyze historical shot data together with environmental data collected by environmental sensors to improve the predictive capabilities of the system 10 in future predictions. For example, the system 10 may identify patterns in how shot predictions are impacted by collected environmental data. These patterns may be used to incorporate or adjust modeling coefficients during future play when the environmental conditions are present. This may be used prior to model calibration using actual shot data in the conditions during play in the affected area or zone.

The map data may comprise a zone map 19 that includes a detailed feature map of a property and a surface model 18. While FIG. 1 illustrates the maps separately, the maps may be present separately or in any combination of combined format as well as represented in data. For example, surface features and zone feature specifications may be assigned to coordinates to which they correspond within a single map. In some embodiments, the surface model 18 may be provided separate from the zone map 19. The map database 12 may include a coordinate map comprising a three-dimensional coordinate space defining an Euclidian space or similar and which may be incorporated in, overlaid, or be projectable onto the surface model 18. In one embodiment, when a zone map 19 is defined separate from the surface model 18 coordinates corresponding to the zones may be defined with respect to the zone map 19. In some embodiments, the map database 12 includes a coordinate map including a two-dimensional coordinate grid that overlays the property. In some embodiments, the coordinates may correspond to GPS coordinates or a proprietary coordinate system. In various embodiments, map data may be collected prior to play using suitable technology such as lidar, laser, photogrammetry, GPS, or the like. In some embodiments, individuals on foot, aircraft, drones, or robots may survey the property utilizing such technology. In one example, lidar, laser and photogrammetry carried by remotely piloted or other aircraft as well as by walking or robotic ground-based devices are used to collect mapping data.

As introduced above, the map database 12 may include a surface model 18 of the property. In some embodiments, the surface model 18 includes surface identification that also includes surface properties such as surface contours, angles, relative heights of surfaces, or both. Surface models 18 may include three-dimensional detail keyed to the coordinate space. In one embodiment, detailed surface properties such as material, firmness, or the like may be incorporated into the surface model 18 or provided separately, for example, in the zone map 19. Surface features may be modeled in various levels of detail in the surface model 18. For instance, in the embodiments described herein, surface features may be specified down to an inch or less. Increased level of surface detail included in the surface model 18 may be used to enhance accuracy of predictions. The surface model 18 may include manmade objects in addition to natural terrain and vegetation of the property. For example, surfaces of objects on the property such as camera towers or grandstands may be modeled to include detailed three-dimensional structures. In one example, trees may be mapped in detail beyond canopy dimensions, e.g., to include limbs and leaf locations, or a bridge may be mapped to include railings and posts. In some embodiments, the map database includes a surface model library of objects such as grandstands, towers, kiosks, walls, or the like that may be incorporated into the surface model of the property by inserting the known surface dimensions into the surface model at the location of the object during play. Thus, surface modeling data of the property may be collected prior to complete tournament setup and then the surface model may be adjusted by incorporating the object surface models from the library at the locations on the property where the object are setup.

The surface model 18 data may be collected using technology such as lidar, laser and photogrammetry carried by remotely piloted or other aircraft as well as by walking or robotic ground-based devices. The accuracy of the surface model 18 will enhance the quality of the shot data to which it relates as well as its use in prediction modeling. Higher levels of accuracy are therefore preferred and technologies such as lidar, laser, and photogrammetry may be used to generate a surface model 18 with accuracy of 1 inch. However, these and/or other surface mapping technologies may be used to improve accuracy to within less than 1 inch. Lower levels of accuracy could also be used, e.g., accuracy to less than 2 inches, less than 4 inches, or less than 6 inches. However, lower levels of accuracy may be accompanied by reduced prediction quality when a ball impacts a surface feature that is not represented in the surface model 18.

As introduced above, the map database 12 may include a zone map 19. The zone map may be keyed to the coordinate space to define zones therein, and which may comprise detailed identification of features present on the property. The features may include natural features such as base ground material, grass, grass type, trees, shrubs and other vegetation. In some embodiments, the features also include manmade elements such as hospitality areas (e.g., grandstands, tents, etc.), camera towers, and other obstructions. In some embodiments, the feature mapping may include specifications such as type of material of the features (concrete, pavement, concrete block, oak, aluminum, pine, etc.). All or a portion of the features may be provided in the surface model 18. In one configuration, the zone map 19 includes zone specifications and is overlaid or associated with surface model 18 to identify zones within the surface model 18 and identify material properties together with surface features therein.

The zone map 19 may identify zones that may be as specific or as general as needed. For example, a component of mapping may include dividing the property into multiple defined zones or otherwise identifying zones within the property to categorize the same. Zones may include one or more features. Zones may include various grounds designations and/or physical features within the course of play and, in some embodiments, outside the course of play, such as out-of-bounds areas within the vicinity of the course where a player may potentially hit a ball. Thus, in some configurations, zones may correspond to areas within and/or around the course of play, such as physical structures (e.g., natural and/or manmade objects, structures, and features). For example, zones may correspond to parts of a golf course, such as tee box, fairway, green, hazard (bunker or water), rough, drop zone, and the like. Zones may include a tee box zone. A tee box zone may include one or more enhanced tee box zones such as a tee left, tee right, tee center enhanced zone. Zones may include one or more zones corresponding to a fairway, such as fairway, fairway bunker, or the like. In a further configuration, zones corresponding to a fairway may include enhanced zones such as one or more of left fairway, right fairway, left fairway bunker, right fairway bunker, or the like. Zones may include one or more zones corresponding to a hazard, such as hazard, grass bunker, fairway bunker, waste bunker, water, or the like. In a further configuration, zones corresponding to a hazard may include enhanced zones such as one or more of front center greenside bunker, front left greenside bunker, left greenside bunker, left rear greenside bunker, rear greenside bunker, right greenside bunker, right rear greenside bunker, right front greenside bunker, or the like. Zones may include one or more zones corresponding to a rough, such as primary rough, intermediate rough, greenside rough, or the like. In a further configuration, zones corresponding to a rough may include enhanced zones such as one or more of left rough, right rough, left intermediate, right intermediate, or the like. Zones may include one or more zones corresponding to a green, such as green, fringe, or the like. Zones may include one or more zones corresponding to landscape and/or nature features, such as bush, tree, step, landscaping, path, rock outline, tree outline, dirt outline, native area, water, or the like. Zones may include physical features such as manmade structures positioned around the course such as one or more of grandstands/seating, camera tower, hospitality tent, building, cart path, pedestrian path, walk strip, wall, bridge, or the like. In some embodiments, one or more zones may be identified as other or unmapped.

The zone map 19 may categorize areas of the property into a plurality of zones. Zones may be used to conveniently categorize features for application of predictive modeling and continuous updating that enables the modeling to automatically account for changing conditions. For example, zones may represent an area of a hole or surrounding grounds having features or objects thereof that are specified by similar material properties with respect to predicting bounce and roll. For example, areas wherein ball behavior with respect to bounce and roll remains similar may be included within a zone of a hole. However, zones may also serve a identifiers of areas of a hole or course that themselves are informative without reference to determination of bounce and roll behavior. Thus, zones are preferably identified with similar areas of a hole or course. The selection of zones may be customized to correspond to a particular course grounds. For example, a course that does not include a step-cut rough would not include an intermediate or first-cut rough.

Figure 2:
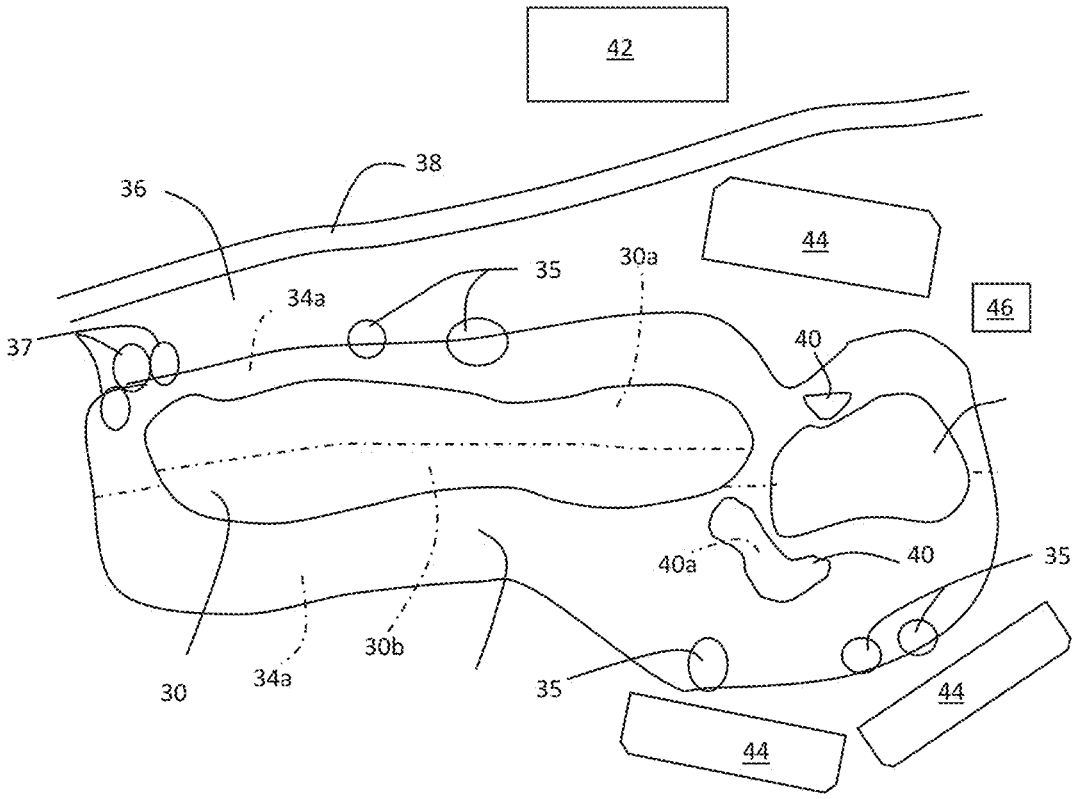
FIG. 2 illustrates zone designations of a portion of a hole and surrounding areas according to various embodiments described herein.

FIG. 2 illustrates zones designation of a portion of a hole and surrounding areas. As described above and elsewhere herein, each zones may be associated with one or more coefficients that may be updated during play. Each zone may also be associated with mapped properties of the features. These properties may be incorporated into prediction models associated with, generated for, or otherwise utilized by the prediction generator 16 to generate predictions with respect to impact coordinates within the zone. The example illustrated in FIG. 2, depicts zones including fairway 30, green 32, rough 34, trees 35, native area 36, bushes 37, path 38, landscaping 39, greenside bunker 40, building 42, grandstands 44, and camera tower 44. The zones further include enhanced zones including left fairway 30*a*, right fairway 30*b*, left rough 34*a*, right rough 34*b*, and right front greenside bunker 40*a*, where the broken lines depict boundaries within each zone with respect to the enhanced zones therein.

In some implementations, the surface model 18 and/or zone map 19 may include tournament structures that may not be in place during onsite map data collection. In such situations wherein the structures are subsequently added to the map data, the coordinate locations occupied by the structures may be identified in the surface model 18 and zone map 19 and pre-mapped surface features and properties associated with each of the structures may be imported into the surface model 18 and zone map 19 or map data thereof, such as from a known object library. For example, one or more structures may be associated with a specification that defines properties of the structure and corresponding surface model 18 that have been previously collected or generated.

It is to be appreciated that some embodiments of the system 10 do not utilize zone strategies for bounce and roll prediction and may, instead, employ a surface model 18 that defines surface location, which may include surface properties in some embodiments, and surface material, which may include properties thereof, keyed to each set of mapped coordinates. Zones may otherwise be identified with respect to the location of coordinates.

The ball tracking network 14 may include a network of cameras, radar, lasers, and/or other suitable ball tracking devices configured to track a ball. According to various embodiments, the ball tracking network 14 may include a camera system positioned around a golf course and surrounding grounds. One or more cameras may track movement and identify distance using an associated laser or rangefinder or via optical calculations, which may include photogrammetry. For example, each camera may calculate the distance a ball or other object of known size by comparing the optically captured size of the object to that of the known size of the object. Further determination of the angle of the camera may be used to plot the location of the object at the distance and angle from the camera relative to a map of the region around the camera. Location determination may be enhanced utilizing multiple cameras, e.g., to triangulate or otherwise determine location of a ball or other object. In one example, an optical map of a region of the course from a view of a fixed camera may be utilized by a camera to determine location of objects relative to known locations within the mapped region, e.g., to determine actual impact location coordinates, bounce characteristics, and/or roll characteristics within the coordinate space. For example, by comparing an image captured of an object to surrounding features in the image of known location, the approximate location of the object may be determined. Optical calculations such as those described above may be used to determine distance to enhance the accuracy of the location determination. In some embodiments, cameras and optical calculations may be applied to measure spin and/or spin axis. In another example, spin and/or spin axis at first impact may be predicted from initial spin data collected shortly after the ball is struck by the player. In an above or another example, radar may be implemented to track objects, which may include location, velocity, trajectory, acceleration, or other parameters. In an above or another example, cameras may be configured for optical recognition. For instance, cameras may utilize ball/shape recognition, or the like that is used to identify balls to thereby pair location of a ball with location coordinates via a coordinate map. In one embodiment, cameras may utilize optical recognition/augmented reality (AR) to locate balls. Cameras may typically be located at known locations, but in some instances one or more cameras may be utilized in a mobile environment, e.g., utilizing real time kinematic base stations or location methodologies with respect to the camera. In some embodiments, cameras may be used to identify motion and objects and a laser or rangefinder associated with a camera may target such objects to determine distance of the object from the camera. Combining camera view angle with distance, the location of the object may be determined. In some embodiments, features specified in the surface model 18 or other topography of areas may be used to assist in distance calculations. In some embodiments, such camera systems are operated by a human, robot, or fully autonomous. Cameras may operate in the visual spectrum and/or optical spectrum to include one or more of the visual spectrum, ultraviolet spectrum, or infrared spectrum.

In one example, the ball tracking network 14 may be configured to track a ball and identify an initial impact location of the ball and provide the first impact coordinates to the prediction generator 16, described in more detail below. The ball tracking network 14 may be further configured to measure ball impact physics with respect to the first impact location. For example, ball impact velocity and angle may be obtained by radar. In a further example, ball impact physics may include spin, which may include spin axis, at first impact. In another or a further example, the ball tracking network is configured to provide tracking data used by a flight simulator 22 to generate a stroke trail polynomial describing the ball flight. In a further example, the flight simulator 22 may predict a first impact location using the stroke trail polynomial that the physics simulator 24 uses to model bounce and roll following impact. In one embodiment, one or more aspects of ball impact physics is predicted from the stroke trail polynomial.

The ball tracking network 14 may be configured to track bounce and roll and/or final resting position. In some such examples, the ball tracking network 14 may also collect one or more bounce characteristics such as bounce number, height, length/distance, spin, spin axis, acceleration, velocity, inbound bounce angle, outbound bounce angle, direction, or combinations thereof, and/or one or more roll characteristics such as distance, acceleration, deceleration, max/min velocity, velocity variability, velocity between two or more points, direction, or combination thereof. In some embodiments, the actual ball bounce and roll data may be stored in a historical shot database 18 for subsequent analysis by the update engine 26 to update current or future prediction models. In one example, the system 10 continuously updates prediction models based on comparison of actual and predicted ball behavior, e.g., bounce and roll and/or final resting position, utilizing shot data collected by the ball tracking network 14.

As introduced above, the system 10 may include a prediction generator 16 configured to output a predicted final resting position of a ball and/or a bounce and roll model that provides a prediction of the bounce and roll of a ball. The prediction generator 16 may include a flight simulator 22 configured to predict a first impact location based on a stroke trail. For example, the flight simulator 22 may receive ball flight data collected by the ball tracking network 14 and generate a stroke trail polynomial that describes the flight of the ball. In one example, the flight simulator 22 is configured to generate a first impact location before the ball actually impacts the ground. In one example, the ball tracking network 14 identifies the first impact location. The prediction generator 26 may include a physics simulator 24 comprising prediction models 20 to predict final resting position of a ball and/or bounce and roll behavior. In one configuration, each zone or enhanced zone is associated with a prediction model 20 that the physics simulator 24 applies to actual or predicted impact location and physics to model bounce and roll and predict final resting position, which may include a predicted zone in which the ball rests.

Prediction models 20 may include or incorporate various properties of materials associated with the corresponding zone, such as yield strength, elasticity, density, hardness, friction, adhesion, coefficient of friction, stimp values, coefficient of restitution, or the like, which may be incorporated or looked up from detailed map data described here. To increase accuracy, prediction models 20 may incorporate properties of a golf ball, such as surface dimensions, center of gravity, yield strength, elasticity, density, hardness, friction, adhesion, coefficient of restitution, or the like. Prediction models 20 associated with the various zones may include coefficients that an update engine 26 updates during play, e.g., via application of a sliding window of shots, such as by fitting the prediction model 20 to a sliding window of shots. The coefficients may be associated with terms in the prediction model 20. The terms may further include properties of zone features such as surface model data. In one example, coefficients may be determined using regression analysis or other suitable techniques. Coefficients may include parameters or values thereof. In one example, the prediction model 20 utilizes machine learning and actual and predicted shot data is used to train and/or tune parameters and/or hyperparameters of the model, e.g., in a machine learning environment.

Prediction models 20 may be associated with zones for which the prediction models 20 correspond. For example, prediction models 20 may incorporate physical properties of features or materials thereof to which a zone includes and that a ball my impact. In some embodiments, a prediction model 20 may be initially fitted or trained/tuned to similar surface features or materials thereof prior to use during an event. This initial fitting or training/tuning may be represented by one or more coefficients that are associated with the zone and that are used by the prediction generator 16 to generate predictions. Utilizing a prediction model 20 that incorporates physical properties of features and coefficients associated with a zone, the prediction generator 16 may execute operations that calculate predicted bounce and roll behavior and/or final resting position of balls following a first impact of the ball during play. A first impact may be ground impact or impact with an object, such as a tree, wall, building, or other feature within a zone to which the prediction model 20 is assigned, which may be specified in the mapping data as described herein. In some embodiments, prediction models 20 associated with each zone may be generated from a base model by the prediction generator 16 by incorporating values of physical properties of one or more features within the zone and the one or more coefficients.

As noted above, zones may be as general or as specific as desired. In some embodiments, a feature or object thereof is divided into or includes multiple zones or enhanced zones that are specific to a material property found in the zone. For example, a bridge zone may correspond to a bridge having wood planks and metal railings. The bridge zone may be divided into or include an enhanced wood plank zone and an enhanced metal railing zone. Similarly, a tree zone may correspond to one or more trees. The tree zone may be divided into or include a trunk zone that corresponds to a trunk and large limbs, a limb zone that corresponds to limbs below a predefined diameter, and a leaf zone that corresponds to bushels of leaves. Leaf zones may be further divided into more enhanced zones corresponding to leaf density. In the two above examples, the enhanced zones define overlapping zones that contain different feature properties. In some such examples, each of the enhanced zones may be associated with a prediction model 20 that incorporates the different feature properties and that is associated with corresponding coefficients. Thus, the area comprising the overlapping zones are associated with one or more separate coefficients that are used to generate the prediction. In the above examples, the prediction generator 16 may be configured to apply the prediction model 20 associated with the enhanced zone as the prediction model 20 that is more specific to the impact coordinates. In one example, the prediction model 20 includes multiple prediction models 20, each corresponding to an impact, bounce, or role location. For example, a ball may be predicted to hit a tree limb. The physics simulator 24 may apply the prediction model 20 corresponding to the tree limb to predict a bounce and subsequent impact location. Using the coordinates of the predicted subsequent impact location, the physics simulator 24 may apply the relevant prediction model 20 to predict a subsequent bounce, roll, or resting position, as the case may be. The physics simulator 24 may repeat this process for each subsequent prediction by applying the applicable prediction model 20 for the predicted location. As explained in more detail below, in some embodiments, the physics simulator 24 may calculate location probabilities for impacts, bounces, rolls, or the like and simulate further ball behavior from multiple locations to predict multiple behaviors. For example, the physics simulator 24 may generate multiple predicted bounce and roll behaviors for a shot. The physics simulator 24 may assign probabilities to the various predicted model outcomes. These outcomes may be used to generate zone probabilities by associating probabilities the ball will come to rest in a particular zone. These probabilities may be used to report predicted zone location to data platforms, which may be before the ball impacts or comes to rest. In some embodiments, the system 10 applies a threshold probability and does not report zone predictions or only zone predictions associated with a threshold probability. In one example, the zone predictions are served to data clients with probabilities. In one example, the zone predictions or resting locations are provided to television cameras or a human or automated ball spotters to notify of likely ball location to look for the ball. In some embodiments, a human or automated spotter may spot the location of the ball, e.g., via a laser, and the actual coordinates may be cross referenced with the predicted zone or coordinates and, when the predicted and actual zones are different, a zone update is sent to data clients.

In some embodiments, coefficients for a zone will apply equally to those of an enhanced zone located within the zone. For example, with reference again to FIG. 2, the prediction model 20 may apply the same prediction model 20 to predict the behavior of a ball that impacts the fairway 30 within the enhanced left fairway 30*a* or right fairway 30*b* zones. That is, is some configurations, the one or more coefficients associated with the fairway 30 zone are also associated with the enhanced left fairway 30*a* and right fairway 30*b* zones. The update engine 26 may similarly update the one or more coefficients for application to the same. As described in more detail below, enhanced zones may be utilized or otherwise reported with respect to description of the bounce and roll or final resting position to provide enhanced information regarding the behavior and location of the shot. Similarly, the greenside bunker 40 zone and enhanced right front greenside bunker 40*a* enhanced zone may be associated with the same one or more coefficients and the enhanced zone may be utilized or otherwise reported with respect to description of the bounce and roll or final resting position to provide enhanced information regarding the behavior and location of the shot. In instances when additional greenside bunker zones are included, the different greenside bunkers or enhanced zones thereof may or may not be associated with the same one or more coefficients as the enhanced right front greenside bunker 40*a*.

In various embodiments, the prediction generator 16 may apply multiple prediction models 20 to a single shot. For example, a tree zone may be located adjacent to or within a primary rough zone and be associated with different physical properties and coefficients than the rough zone and, thus, the prediction model 20 applied for impacts to coordinates corresponding to the tree zone may be different than that applied for impacts to coordinates corresponding to the rough zone only. However, if the ball that hits the tree zone is predicted to bounce out of the tree and onto the grass of the rough zone, the physics simulator 24 may be configured to apply the predicted ball impact physics of the bounce and subsequent behavior to the prediction model 20 associated with the rough zone.

As introduced above, prediction models 20 may be updated during play. Updating may include updating coefficients or otherwise fitting or training/tuning models with actual shot data from shots impacting the zone collected during play. In various embodiments, the prediction model 20 may include an initial coefficient at the start of play. Such coefficients may be experimentally established in a laboratory setting or via analysis of impact data obtained from actual golf play. For example, golf ball impact with various materials (e.g., ground base material such as various grass types, sand, waste area, gravel, rocks, concrete, pavement, wood, metals, plastics, or the like and/or objects such as one or more types of trees, shrubs, tents, roofs, walls, television towers, grandstands, buildings, or the like) a ball may potentially impact may be tested in a controlled laboratory environment and/or extracted from analysis of actual golf play, e.g., obtained from previous live prediction analysis or derived from historical shot data, which in one configuration includes consideration of collected environmental data with respect to the historical golf data. This may be performed, for instance, using radar, cameras, and/or other techniques to measure impact variables such as impact angle, velocity, spin, or spin axis and subsequent bounce, roll, and/or final resting location variables such as bounce number, height, length, acceleration, velocity, spin, spin axis, inbound bounce angle, outbound bounce angle, bounce or roll direction, roll distance, roll acceleration and/or deceleration, stimp, max/min roll velocity, roll velocity variability, roll velocity between two or more points, direction bounce number, velocity, acceleration, bounce angle, height, spin, spin axis, bounce impact angle, direction, or the like. In various embodiments, measured impact variables and subsequent variable data may be collected under specific conditions (e.g., environmental and/or state of one or both of the materials that are impacting such as dry, moist, saturated, cold, mild, hot, etc.). This data may be input into the system 10, such as a historical shot database thereof, for subsequent use to calculate initial coefficients for use in prediction models 20 associated with zones corresponding to similar conditions. For example, measured impact variable data and subsequent actual bounce, roll, and/or final impact position may be collected for various ground materials, e.g., grass type of certain lengths, while under various stages of saturation and temperature. Prior to an event, initial coefficients for a prediction model 20 for a fairway including dry zoysia on a mild day may be generated by applying the prediction model 20 to the measured impact variable data collected from shots impacting dry zoysia on a mild day and comparing the predicted bounce, roll, and/or final resting position with the corresponding measured bounce, roll, and/or final resting position. In some embodiments, collected shot data or coefficients may be tagged with conditions under which they relate. Prior to an event, the prediction generator 16 may search the collected shot data and/or coefficients for tags corresponding to current conditions of a zone for use as or to generate initial coefficients. In an above or another configuration, coefficients specific to conditions may be averaged for initial use for zones having similar materials under similar or different conditions. In one configuration, coefficients may be subjected to a weighted average calculation that takes into account the historical occurrence and/or future probability of the presence of the conditions from which they were calculated.

The prediction generator 16 may be configured to incorporate course surface topography with respect to generating predictions. For example, the prediction generator 16 may be configured to utilize the surface model 18 and zones thereof to predict final resting position and/or bounce and roll behavior of a ball. In one configuration, topographical data corresponding to impact location coordinates are input into a prediction model 20 to model bounce and roll behavior and/or final resting position. For example, prediction generator 16 may cross-reference impact location with the surface model 18 to obtain surface properties corresponding to the impact location. The surface properties may include a surface angle of the impact location. The surface properties may be input into the relevant prediction model 20 to identify bounce and roll behavior and/or final resting position of the ball.

As introduced above, the system 10 may employ a prediction model 20 to predict bounce and roll of a ball following impact to output a final resting position prediction for the ball. In various embodiments, the prediction model 20 takes as input ball impact physics variables, e.g., impact angle, velocity, spin, which may include spin axis, and predicts bounce and roll and/or final resting position of the ball incorporating surface properties from the surface model 18 associated with coordinates corresponding to impact/bounce and roll locations and zone coefficients. In some embodiments, the first impact coordinates may also be input into the prediction model 20.

In one embodiment, the prediction model 20 is configured to output a distance from an initial impact position. The output may be directionless or specify a direction or angle the system 10 is to apply the output distance prediction from the initial impact location, which may be relative to a predetermined reference point.

In some embodiments, the prediction model 20 may take as input values ball impact physics variables, surface topography corresponding to the impact location, and first impact coordinates of the ball corresponding to the surface model 18 or another map of the grounds. The coordinates may further correspond to one or more zones. Applying the model, including the surface model 18 and ball impact physics, to the data from the first impact coordinates, the prediction model 20 may be configured to output coordinates that correspond to a predicted final resting position of the ball. In an above or another embodiment, the output may comprise predicted coordinates or other data the prediction generator 16 may use to identify a predicted final resting position and/or a predicted bounce and roll model. In one example, the prediction model 20 may be configured to segment the prediction or associated calculations by each bounce, impact, and roll. For example, the output may comprise coordinates of predicted ball position at one or more points during one or more bounces, impacts, and/or rolls. In one configuration, the output and/or segments of an output may be associated with a direction and value, e.g., distance from an impact location, that may be used to model the bounce or roll to identify a next impact position or final resting position. In one example, the output comprises one or more numeric values of variables for input into one or more pre-defined equations for modeling bounce and roll. In one example, the output may comprise height, time, and distance or height and one or more speeds of the ball during each bounce and a roll distance.

In an above or another embodiment, the coordinates may correspond to or translate into a three-dimensional Euclidean space for modeling bounce and roll behavior, determination or identification of bounce locations, and/or determination or identification of final resting position. In one example, the three-dimensional Euclidean space, the surface model 18, or both may be defined or projectable within one or more coordinate systems. The coordinate system may include orthogonal coordinate systems, e.g., Cartesian coordinate and non-Cartesian orthogonal coordinate systems, curvilinear coordinate systems, or the like. In some examples, the coordinate system includes one or more coordinate and/or conformational maps.

In one example, the prediction model 20 takes as input ball impact physics, surface topography, and actual or predicted coordinates corresponding to the first impact location within the three-dimensional Euclidean space and generates bounce and roll and/or final resting position predictions within the defined coordinate system. The bounce and roll and/or final resting position predictions may incorporate one or more zone coefficients corresponding to one or more zones the ball impacts, bounces, or rolls as well as surfaces corresponding to impact, bounce, and roll coordinates.

Figure 3:
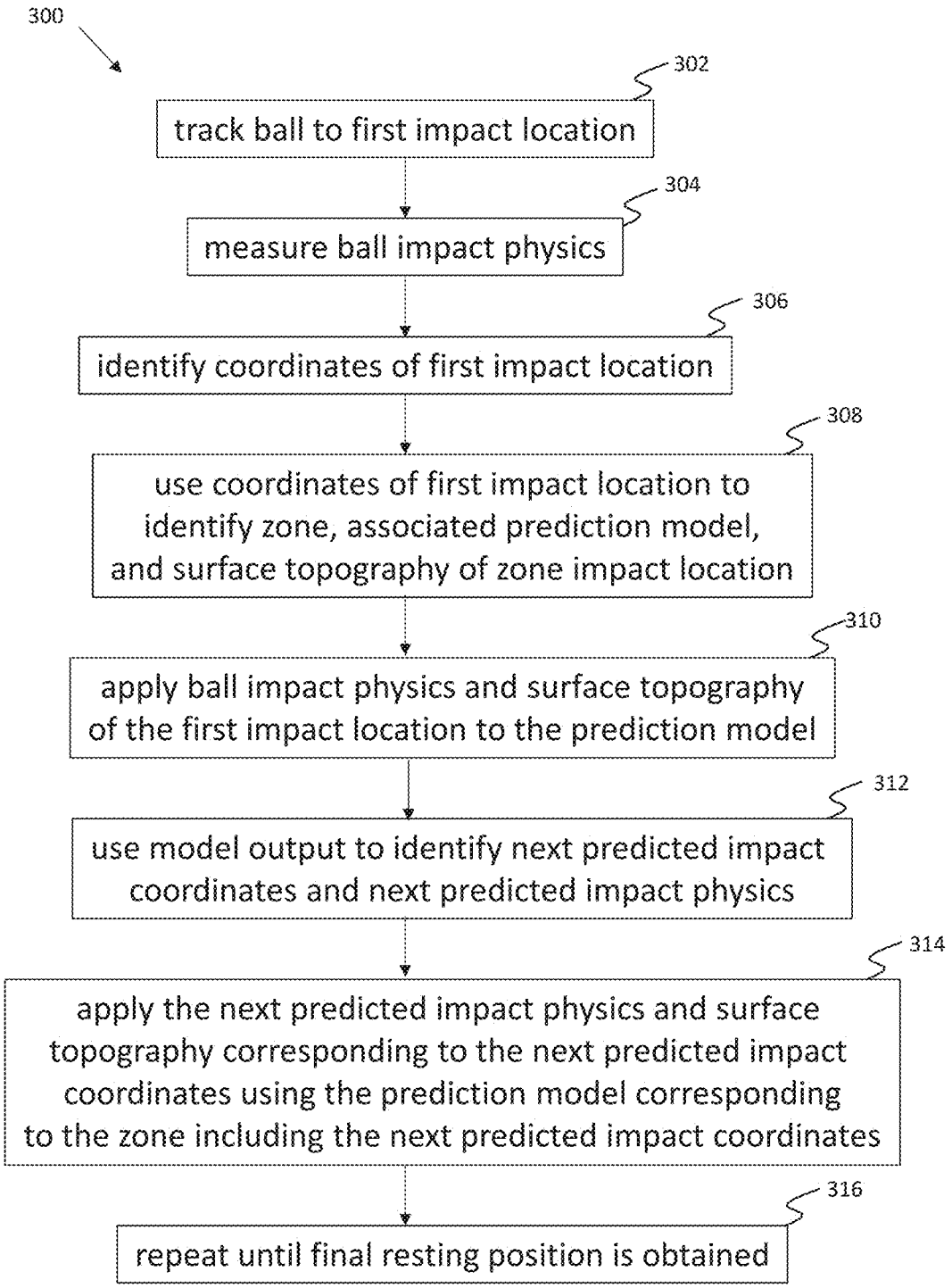
FIG. 3 illustrates operations for determining a final impact location according to various embodiments described herein.

As noted above, the output and/or segments of an output may be associated with a direction and value, e.g., distance from an impact location. In some embodiments, output coordinates are provided as coordinates relative to the three-dimensional Euclidean space. For example, the initial impact location may be set to an origin or other coordinate and coordinates corresponding to subsequent predicted positions of the ball during bounces, impacts, and rolls may be defined thereafter within the space. In some embodiments, the system 10 or physic simulator 24 thereof may overlay or project the space relative to the surface model 18 to generate position coordinates relative to the surface model 18, model the predicted ball behavior, and/or identify a predicted final resting position if not otherwise output. In some embodiments, property areas or zones thereof may be separately defined within the three-dimensional Euclidean space FIG. 3 illustrates a method 300 of determining a final resting location according to various embodiments. The ball tracking network 14 may track a ball to a first impact location 302. The ball tracking network 14 may further measure impact physics variables 304 such as impact angle and impact velocity to obtain associated values. In some embodiments, the ball tracking network 14 may further measure spin and/or spin axis. The ball tracking network 14 may further access the map database 12 to identify the coordinates of the first impact location 306. The ball tracking network 14 may transmit or otherwise provide the first impact coordinates and ball impact physics to the prediction generator 16. The prediction generator 16 or the ball tracking network 14 may access the map database 12 to obtain the zone corresponding to the impact coordinates, the surface topography of the impact coordinates, and the prediction model 20 corresponding to the zone 308. In some embodiments, the first impact coordinates may also be input into the prediction model 20. When the ball tracking network 14 obtains the zone and surface topography, the ball tracking network 14 may transmit or otherwise provide the prediction generator 16 with the data. The prediction generator 16 may apply the ball impact physics and surface topography data corresponding to the first impact location to the prediction model 310. The prediction generator 16 may then use the prediction model 20 output to identify next predicted impact coordinates and next predicted impact physics 312, which may be by any suitable methodology, such as those described above. In some situations, such as when the ball is not predicted to undergo further impacts, next impact locations may not be reflected in the output. In such cases wherein roll is predicted, the output may identify roll characteristics that include or may be used to identify final resting position, e.g., by applying the roll characteristics to the surface model 18, zone map 19, or other map including the coordinates of the modeled space. If no further movement is predicted, the impact location corresponds to the predicted final resting position. If the output predicts a next impact location, the prediction generator 16 may use the next predicted impact physics and surface topography corresponding to the next predicted impact coordinates as inputs into the prediction model 20 corresponding to the next impact location 314. In some embodiments, the next impact location corresponds to the same zone and coefficients as a prior impact location and the same prediction model 20 may be used again. The method may be repeated for subsequent predicted next impact locations until a final resting position is obtained 316.

Figure 4:
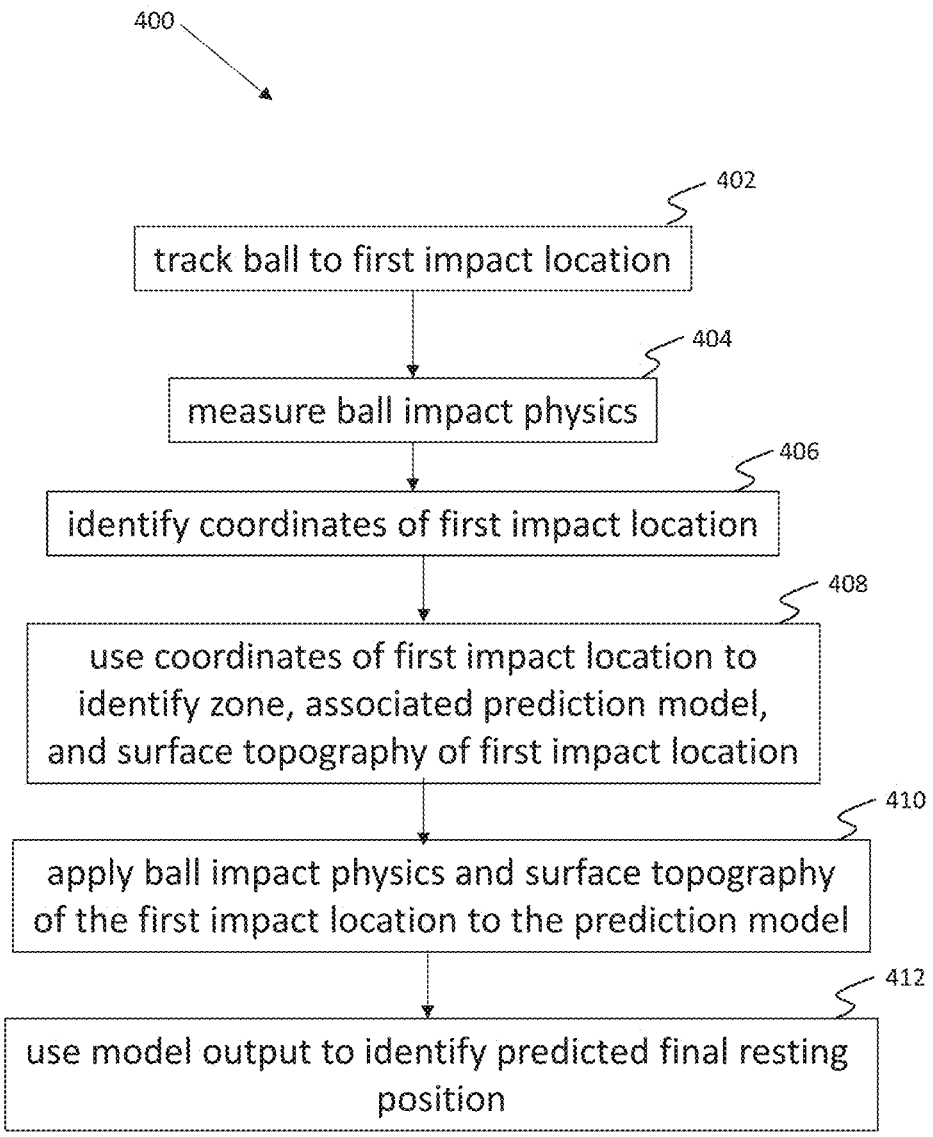
FIG. 4 illustrates operations for determining a final impact location according to various embodiments described herein.

FIG. 4 illustrates a method 400 of determining a final resting location according to various embodiments. The ball tracking network 14 may track a ball to a first impact location 402. The ball tracking network 14 may further measure ball impact physics variables 404 such as impact angle and impact velocity to obtain associated values. In some embodiments, the ball tracking network 14 may further measure spin and/or spin axis. The ball tracking network 14 may further access the map database 12 to identify the coordinates of the first impact location 406. The ball tracking network 14 may transmit or otherwise provide the first impact coordinates and ball impact physics to the prediction generator 16. The prediction generator 16 or the ball tracking network 14 may access the map database 12 to obtain the zone corresponding to the impact coordinates, the surface topography of the impact coordinates, and the prediction model 20 corresponding to the zone 408. In some embodiments, the first impact coordinates may also be input into the prediction model 20. The prediction generator 16 may then apply the ball impact physics and surface topography of the first impact location to the prediction model 410, and use the model output to identify a predicted final resting position 412.

As introduced above, the prediction generator 16 may include an update engine 26 configured to update prediction models 20, such as coefficients associated with zones. The update engine 26 may be configured with customized update schedules and input data upon which updated coefficients are generated. For example, the update engine 26 may be configured to update prediction models 20 at predetermined time intervals, shot intervals, upon the occurrence of a predetermined event, on demand, dynamically, or otherwise. The update engine 26 may update prediction models 20 based on actual historical data of final resting position and/or bounce and roll data collected during tournament play. Various sources of historical data may be utilized alone or in combination. For example, the historical data may correspond to data collected from shots hit in a same or similar zone, shots hit on the same day or previous days on the same course, same hole, similar courses, similar holes, or a combination thereof. As described in more detail below, in one configuration, the update engine 26 fits or trains/tunes models on a continuous basis utilizing a sliding window of historical shots hit on the same day, same hole, and that impact the same zone to which the prediction model 20 that is being updated is associated. In another example, the historical data may correspond to data collected from shots irrespective of time, course, or hole.

Fitting or training/tuning the model may generate one or more coefficients and/or updated coefficients for one or more terms of the prediction model 20. For example, the ball tracking network 14 may track bounce and roll and/or final resting position from which the update engine 26 compares to corresponding predicted bounce and roll and/or final resting position to fit the model. In some such examples, comparing predicted and actual bounce and roll and/or final resting position may include comparing predicted bounce, roll, and/or final resting position characteristics with actual bounce, roll, and/or final resting position characteristics collected by the ball tracking network 14. In one embodiment, characteristics may include one or more bounce characteristics selected from bounce number, height, length, acceleration, velocity, inbound angle, outbound angle, direction, or combinations thereof, and/or one or more roll characteristics selected from distance, acceleration, max/min velocity, velocity variability, velocity between two or more points, direction, or combination thereof.

In some embodiments, the update engine 26 may be configured to update prediction models 20 continuously on a rolling basis that fits or trains/tunes the models to a sliding window of actual historical shots. Updating based on a sliding window of actual historical shots obtained the same day, on the same hole, and in the same zone may be utilized to adapt the prediction models 20 to changing conditions on the course without specifically incorporating condition data. For example, the update module may be configured to continuously update a prediction model 20 based on actual and predicted ball behavior, e.g., bounce and roll and/or final resting position, by fitting the model to a predetermined number of previous shots for which actual and predicted data corresponding to the area or zone the model applies has been obtained.

Further to the above, the update engine 26 may be configured to apply a sliding window of collected ball behavior data obtained from a number of previous shots to modify prediction models 20 in a manner that continuously updates the predictive capabilities of the prediction models 20 to correspond to current conditions. Actual and predicted bounce and roll and/or final resting position locations may be compared for a previous number of available shots taken on the hole on the day that impacted the zone and used to update coefficients corresponding to the zone. When a ball impacts the zone, the prediction generator 16 may apply the current prediction model 20 for the zone with the updated coefficients to predict bounce and roll behavior and/or final resting position. The ball tracking network 14 may also collect actual bounce and roll behavior and/or final resting position that the update engine 26 utilizes for comparison with that predicted to update the prediction model 20 for the particular zone to generate a new current prediction model 20, e.g., updated coefficients, for the particular zone. As a result, updating prediction models 20 via application of the sliding window may result in prediction models 20 automatically fitting or tuning to specific conditions (e.g., current environmental conditions) of a hole as play continues. The update engine 26 may automatically update the prediction models 20 when data is available to operate in an unsupervised feedback loop that adapts to changes in conditions over time without a need to retrain.

In some instances, use of the data derived from a comparison of actual and predicted data from a current shot removes data derived from comparison of actual and predicted data from an earlier shot that has now been placed outside of a set number of shots specified by the sliding window. For example, a sliding window may be configured to utilize a set number of prior shots, e.g., 10, to update zone coefficients corresponding to a prediction model 20 for a particular zone. The shot data may be handled on a first-in first-out basis that maintains the historical shot data to that of the set number of shots. The set number of shots in the sliding window may be customizable to any number of shots. Example sliding shot windows include between about 4 and about 100 shots or more. The number of shots is preferably chosen to allow the prediction model 20 to adapt to current conditions while not overly biasing to earlier conditions of a narrow set of most recent data. Thus, the zone and ball impact traffic within the subject zone may be considered. For instance, a zone that is regularly impacted, such as the fairway, may have a higher set shot number while a zone that is not regularly impacted may benefit from a lower set shot number. Thus, in one example, the number of shots in a sliding window for one zone or group of zones may be different than that of another zone or group of zones. In some embodiments, the number of shots used may be dynamically set based on course conditions. For example, if tournament play has been suspended for rain, prediction models 20 for one or more zones may be reset or the sliding window applicable to the model may be modified to include fewer shots or shots taken between a particular time prior to the delay. For example, shots taken 20 minutes prior to the delay may be removed from the window. In such instances, the sliding window may or may not repopulate the window with older shot data that had previously fallen out of the sliding window. As noted above, the system 10 may be configured to filter the historical data to remove outliers. For example, in embodiments that include a sliding window or other update strategies, the system 10 may exclude actual/predicted shot data from shots where the predicted bounce and roll behavior and/or final resting position differed from that of the actual by a specified absolute value or falls outside a range of values. While the historical shot data is preferably taken from the same zone of the hole on the same day, in some embodiments, the historical shot data used in the sliding window may be supplemented with historical shot data from a different day corresponding to the same zone and hole or a similar zone of a different hole of the course on the same day under similar environmental conditions.

Figure 5:
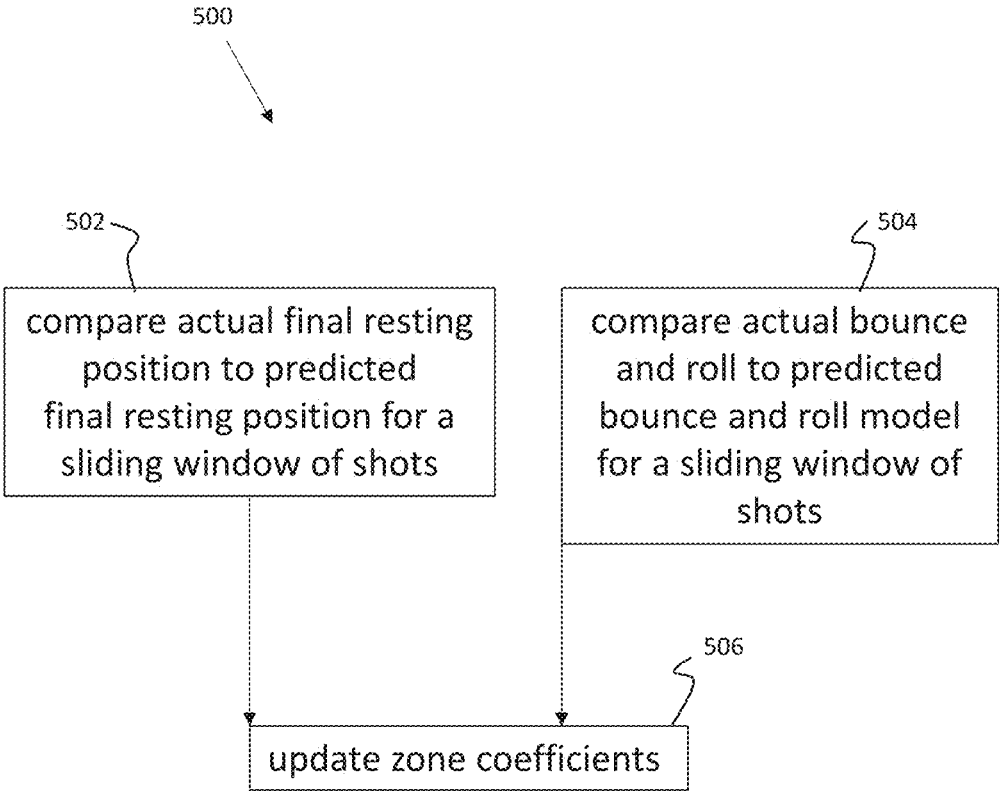
FIG. 5 illustrates operations for updating a prediction model according to various embodiments described herein.

FIG. 5 illustrates a method 500 of updating prediction models 20 for zones using a sliding window approach, as described herein, according to various embodiments. In one example, the update engine 26 may compare actual final resting position to predicted final resting position for a sliding window of shots 502 and use the comparison data to update the zone coefficients 506. According to another example, the update engine 26 may compare actual bounce and roll characteristics to predicted bounce and roll characteristics for a sliding window of shots 504 and use the comparison data to update zone coefficients 506.

As introduced above, zones may be associated with initial coefficients. Initial coefficients may be updated as described above. In configurations that utilize a sliding window strategy, the update engine 26 may update the coefficients upon generation of a prediction with respect to the zone and receipt of actual historical shot data corresponding to the shot. In one example, the update engine 26 may weigh the comparison data, e.g., by a representative portion of the set number of shots or greater. Subsequent updates may similarly weigh the comparative data until all or a predetermined portion of comparative data corresponding to the set number of shots is available. In another example, the update engine 26 may wait to update the prediction model 20 with comparative data until greater than one or a larger portion of the set number of shots are available for use in updating the model. In a further example, the multiple shots may be weighted, such as described above, until a complete set of comparative data of the set number of shots is available. As noted above, the comparative data may still be subject to filters that remove outliers; thus, outliers may be excluded from the set number of shots.

In any of the above or another example, the system 10 may optionally include various environmental sensors that detect environmental conditions with respect to the course, which the system 10 may utilize to enhance a prediction model to account for the measured conditions. In some embodiments, environmental conditions may be incorporated as coefficients or terms that modify properties of the features impacted by the environmental conditions, such as ground hardness, ground saturation, temperature, rain, air pressure, temperature, humidity, or the like. In another or a further example, historical shot data from zones having similar feature properties in similar environmental conditions, or coefficients thereof, may be used to update or modify coefficients. Example environmental sensors may include, but are not limited to, ground hardness sensors, such as soil moisture sensors, weather sensors, or a combination thereof. Soil moisture sensors may be positioned in ground at one or more locations around the course to detect ground saturation. As drainage and terrain differs along different areas of a hole and course, in some examples, soil moisture sensors are posited at multiple locations of a hole, such as along one or more locations of a fairway, one or more locations of a rough, one or more locations of a green, or combination thereof. In some embodiments, the data received from soil moisture sensors may be used to predict a ground hardness that the system uses when predicting bounce and roll. In another or a further embodiment, the data received from soil moisture sensors may be used to modify a current ground hardness coefficient in a dynamic calibration described herein. For example, soil moisture may increase or decrease during play, such as between shots interacting with the ground in a zone or other area in which soil moisture is measured. The system 10 may utilize measured changes in soil saturation to modify ground harness coefficients during play to enhance predictions. For example, if it rains during play, the increased soil saturation may be detected and the update engine 26 may reduce a ground hardness coefficient prior to a next shot interacting with the now softer ground rather than waiting to adjust the ground hardness coefficient utilizing actual measured data from the shot. This may be used to increase predictive accuracy during changed conditions. Additionally or alternatively, the system 10 may perform a dynamic calibration with respect to ground hardness utilizing the actual measured data from the shot and subsequent shots as described herein.

In one embodiment, the update engine 26 may update one or more coefficients based on environmental data. For example, if a rain gauge detects rain, the prediction generator 16 may access historical shot data or coefficients to match with the current environmental conditions. The update engine 26 may update coefficients prior to a next shot that corresponds to the detected rain and how similar rain fall impacted coefficients in the past. In one example, the update engine may consider the current coefficient value used for the zone and match that value with a similar value for a historical zone and update the coefficient value by an value observed with respect to the historical zone following similar amount of rain fall. Thus, using historical shot data collected under a variety of conditions, the system may compare current coefficients to historical coefficients and update the current coefficients to account for changed conditions observed with respect to historical coefficients following similar changed conditions.

Coefficients may include a stimp coefficient used to enhance predictive accuracy of bounce, roll, or both. Stimp coefficients may be specific to a zone type (fairway, green, sand bunker, etc.), specific zones, or combination thereof enhanced zone, or the other area. Weather sensors, such a wind gauges, rain gauges, thermometers, air pressure sensors, humidity sensors, or the like may additionally or alternatively be used to measure local environmental conditions. For example, data collected from rain gauges may be used to predict ground hardness as described above. Additionally or alternatively, rain gauges may be used to predict In various embodiments, zone determinations with respect to final resting location may be output to various platforms or otherwise used for record keeping. The system 10 may be configured to determine confidence of a zone prediction and predict resting position. For example, the predicted resting location of the ball may be analyzed to determine its proximity to other zones. If there is no other zone near the predicted resting ball location, the confidence may be determined to be at a high level.

The system 10 may utilize the prediction data in various manners. For example, the system 10 may utilize the prediction data to output fast predictions of final resting position and/or associated zone for use by data clients that require such fast predictions, such as for uses related to gambling. In one example, the system 10 may be configured to transmit the prediction data to television cameras to provide the cameras with information that may be used to quickly locate a ball for telecasts. In another example, the prediction data may be used to define dark zones where cameras cannot reach. For example, if a ball initially or subsequently impacts a dark zone, the system 10 may be able to predict a final resting position to direct personnel to the predicted location of the ball. In another example, the prediction data may be used for presentation purposes and to fill shot coordinates when not otherwise available, which may include digital platforms.

The systems and methods described herein may include further functionalities and features. For example, the prediction generator 16 may be configured to generate prediction models 20 that incorporate various properties and/or associate multiple coefficients that are to be conditionally applied to shot predictions. For example, coefficients or terms may be experimentally established for specific ball types, groups of ball types, or a representative sample of ball types or groups of ball types. While some embodiments may utilize the same coefficients and terms irrespective of a ball involved in an impact, some configurations may utilize specific coefficients or terms corresponding to a ball type or group of ball types of a ball involved in the impact. These coefficients or terms may be tagged for the corresponding ball type and/or averaged or normalized into one or more groups of ball types. In one embodiment, the system 10 is configurable to utilize the same coefficients and terms irrespective of ball type involved in an impact or select one or more coefficients corresponding to a type or group of ball types involved in an impact.

Still further functionalities and features may include additional incorporation of historical shot data into the predictive modeling operations described herein. For example, the system 10 may be configured to collect shot data on an ongoing basis for incorporation into prediction modeling operations. In various embodiments, the system 10 is configured to incorporate historical shot data for use in modeling the behavior of shots struck by golfers. In another or a further embodiment, the system 10 may be configured to incorporate historical shot data including other physics elements in the natural conditions related to the historical shot data. For example, historical shot data may be tagged or otherwise associated with one or more conditions corresponding to the conditions the shot data relates, such as weather conditions (e.g., temperature, humidity, dew point, wind speed, wind direction, wind variability). In one embodiment, the flight simulator 22 utilizes this data along with shot direction relative to wind direction and shot physics including one or more of launch angle velocity, spin, or spin axis to predict a first impact location. The historical shot data may also include impact and/or bounce and roll physics that may be tagged in the system 10 for use in generating prediction models 20 and/or fitting or training/tuning prediction modules by generating or adjusting coefficients or parameters.

In some embodiments, historical shot data may be maintained in a historical shot data archive. The system 10 may be configured to query the archive for relevant shot data, as identified by tags. Relevant shot data may be tagged by one or more environmental condition, ground condition, player, club, hole, course, zone, or other variable value associated with the shot data available in the archive that may be queried to generate predictive models for prediction of future shots based on physics as well as such variables. That is, historical shot data may be archived in and tagged with respect to one or more associated variable values. The variables may include, for example, environmental variables, ball physics variables, geographic/topographical variables, course variables, player variables, or combinations thereof. Environmental variables may include air pressure, temperature, humidity/dew point, wind variability, wind speed, wind direction (e.g., wind direction with respect to the ball heading). Ball physics variables may include velocity, initial velocity, reduction in velocity between various distances, launch angle, spin, spin axis, apex, distance, rollout/final resting, time of flight, impact angle, or combinations thereof. Geographic/topographic variables may include lie, slope, grass type, grass height, elevation at impact relative to strike, or the like. Course variables may include hole, zone at hit, first impact zone, final resting location or zone, distance of shot, or the like. Player variables may include player name, club, shot shape, right or left handed, ball type, face angle, or the like.

In one embodiment, predictive modeling may incorporate historical data specific to a player or weight/bias a prediction related to a player's first impact location, bounce and roll, and/or final resting location to reflect a player's shot tendencies. Tendencies may be identified by comparing how a player's shot differs from the field or one or more other players with respect to first impact location, bounce and roll, and/or final resting location under similar conditions. This may allow the prediction generator 16 to map variable values that impact bounce and roll and/or final resting position of a particular player compared to other players. In some instances first impact location, bounce and roll, and/or final resting position predictions with respect to a particular player may consistently deviate from those predicted using coefficients or parameters accurate for the field or groups of other players. For example a player may deviate from the field with respect to bounce, roll, and/or final resting position when the player hits shots uphill and/or against the wind. According to various embodiments, the impact coordinate prediction model 21 or prediction model 20 with respect to bounce and roll and/or final resting position may include a player specific calculation, term, or coefficient with respect to one or more terms that incorporates historical shot prediction deviations identified for the player. In some embodiments, multiple players may have similar trends with respect to deviation from first impact location, bounce and roll, and/or final resting location predictions with respect to the field or particular groups of players. In such instances, the impact coordinate prediction model 21 or prediction model 20 with respect to bounce and roll and/or final resting position may include a player group specific calculation, term, or coefficient with respect to one or more terms that incorporates historical shot prediction differences identified for a group of players. Whether applied to a single player or group of players, the player specific aspect may be applied in situations where the deviation has been identified. For example, a player may only vary from predictions relative to the field when hitting from the rough, downhill, in a particular temperature range, or when another variable value is present. Similarly, a single player may belong to multiple different deviation groups based on the presence of certain variables, and when not present, the prediction generation may be configured to exclude a player specific aspect to the prediction models 20. For example, player 1 and player 2 may similarly deviate from a final resting position prediction as applied to the field when a shot has a particular variable value for a club. However, Player 1 may deviate from the field in a manner consistent with player 3 when a shot has a particular value of a different club.

As introduced above, in some embodiments, the system 10 may execute a routine that includes estimating a flight path of a struck ball and determining a prediction of a first impact location from the estimated trajectory. For example, the prediction generator 16 may predict a first impact location based on ball physics measured shortly after club impact, e.g., within 40 ft or less. For example, the prediction generator 16 may apply an impact coordinate prediction model 21 to variable values corresponding to ball physics and one or more variables selected from environmental, geographic/topographic, course, player, or combination thereof to predict first impact location. The impact coordinate prediction model 21 may include terms or otherwise incorporate various measured variable values as inputs to improve the accuracy of the ball flight prediction. The impact coordinate prediction model 21 may incorporate ball physics measurements such as initial velocity, velocity at one or more distances from initial ball strike, launch angle, spin, spin axis, or the like. In some embodiments, direction, such as initial direction of ball flight at impact or at or more distances thereafter, may be included. The measurements may be obtained using radar, lidar, cameras, photogrammetric, and/or other suitable technologies. In various embodiments, the impact coordinate prediction model 21 may further predict ball impact physics and the prediction generator 16 may be configured to predict bounce and roll and/or final resting position as described above from the predicted first impact location and predicted ball impact physics estimated from ball physics measured shortly after club impact.

The prediction generator 16 may select coefficients or parameters based on current measured variable values. The coefficients or parameters may have been fitted or trained/tuned to the impact coordinate prediction model 21 or version thereof prior to use and stored in a library for quick query access when needed. The coefficients or parameters may be tagged with combinations of variable values for which they pertain. In some embodiments, the prediction generator 16 may be configured to access the historical shot data archive and query the archive for shot data tagged with current variable values (e.g., environmental, geographic/topographic, course, player, or combination thereof) similar to those measured for the shot for which the prediction of first impact location is to be made.

In some embodiments, the impact coordinate prediction model 21 incorporates one or more environmental variables associated with a shot when determining a flight path of a golf ball including first impact location. Environmental conditions may correspond to those to which the shot pertains, such as air density, which impacts drag and lift, affecting velocity, spin, trajectory (e.g., height, angle of impact), and distance. The prediction generator 16 may incorporate variables corresponding to air pressure, temperature, and humidity or dew point, for example, to account for environmental variables related to air density. In some instances, air pressure corresponds to altitude. However, in some configurations, local real time air pressure may be included to account for altitude as well as weather. In some embodiments, environmental conditions incorporated into the determination of first impact location include wind speed, wind direction, wind variability. In some instances, variables corresponding to the type of ball may be included.

In some embodiments, the prediction models 20 utilize regression analysis or machine learning, such as neural networks, recurrent neural networks, or the like. In various embodiments, the prediction generator 16 may apply the estimated flight path or location to a coordinate map to identify a first impact location. This may be utilized when ball strike location is unknown. In some embodiments, the estimated flight path may be overlayed on the map to determine a first impact location. The estimated flight path may be projected onto the surface map to identify objects that may impact the flight path and hence the location of first impact. For example, the height of the ball during its trajectory may be compared to heights, which may consider relative elevation of the ball strike location and the mapped objects, to determine if the ball will impact the object. A predicted flight path may take the ball through, over, or into a tree. Thus, when the prediction generator 16 determines the first impact location is a tree, the prediction generator 16 may output a particular coordinate or range of coordinates corresponding to the tree.

In some embodiments, the system 10 is be configured to generate resting position predictions before the ball impacts the ground. For example, predictions may be generated within seconds, such as less than 6 or 7 seconds, after the ball is struck. In one configuration, the flight simulator 22 may receive ball tracking data from the ball tracking network 14. The flight simulator 22 may utilize ball flight data collected by the ball tracking network 14 at one or more points after the ball has been hit to calculate a predicted flight path, or stroke trail. The flight simulator 22 may use the ball tracking data to predict a first impact coordinate using the map data from the map database 12. For example, flight simulator 22 may predict from the ball tracking data and surface model 18 that the ball will impacted a tree and provide the coordinates to the physics simulator 24. In some embodiments, when the flight simulator 22 predicts impact location, in addition to receiving ball flight data from the ball tracking network 14, the flight simulator 22 may receive environmental data from environmental sensors 17, such as one or more of humidity, altitude, temperature, or wind speed and direction for input into an impact prediction model for modeling ball flight and predicting impact coordinates. In some embodiments, the flight simulator 22 may use the ball tracking data to determine an actual impact coordinate using the map data from the map database 12. For example, the flight simulator 22 may determine from the ball tracking data and surface model 18 that the ball impacted a tree and provide the coordinates to the physics simulator 24. The prediction generator 22 may also use the ball tracking data to provide or predict ball impact physics, such as impact angle and velocity. Additional impact physics may also be included such as spin rate or spin rate and spin axis, for instance. The physics simulator 24 may use the coordinates together with the zone map 19 to select the applicable prediction model or models 20 corresponding to the coordinates. The physics simulator 24 may use the actual or predicted impact physics values in the prediction models 20 to generate bounce and roll to predict ball behavior, subsequent coordinates, if applicable, and a final resting position. In some embodiments, when using the prediction models 20, the physics simulator 24 may incorporate parameter values or coefficients from the surface model 18 and zone map 19 corresponding to subsequent impact/bounce and roll locations, such as surface features, e.g., angles, material properties, firmness, stimp, or others described herein. It is to be appreciated that such may be incorporated in the prediction models 20—such that the relevant impact/bounce and roll coordinates identify the prediction model and the predicted physics are input into the model to output ball behavior and resulting next coordinates. In some embodiments, the prediction models 20 may include a firmness coefficient corresponding to a ground firmness in the zone. As described in greater detail elsewhere herein, in some embodiments, the update engine 26 may dynamically update the firmness coefficient values and/or other zone parameter values to enhance the accuracy of the predictions. The update engine 24 may update the prediction models 20. The prediction models 20 may be specific to the zones or specific enhanced zones, e.g., tree limb. The prediction models 20 may include parameter values or coefficients corresponding to materials, surface features, such as topography, or other model aspects. In some embodiments, the update engine 26 may be configured to update the values or coefficients based on changed conditions, e.g., environmental conditions such as rain, soil saturation, temperature, or the like.

Figure 6:
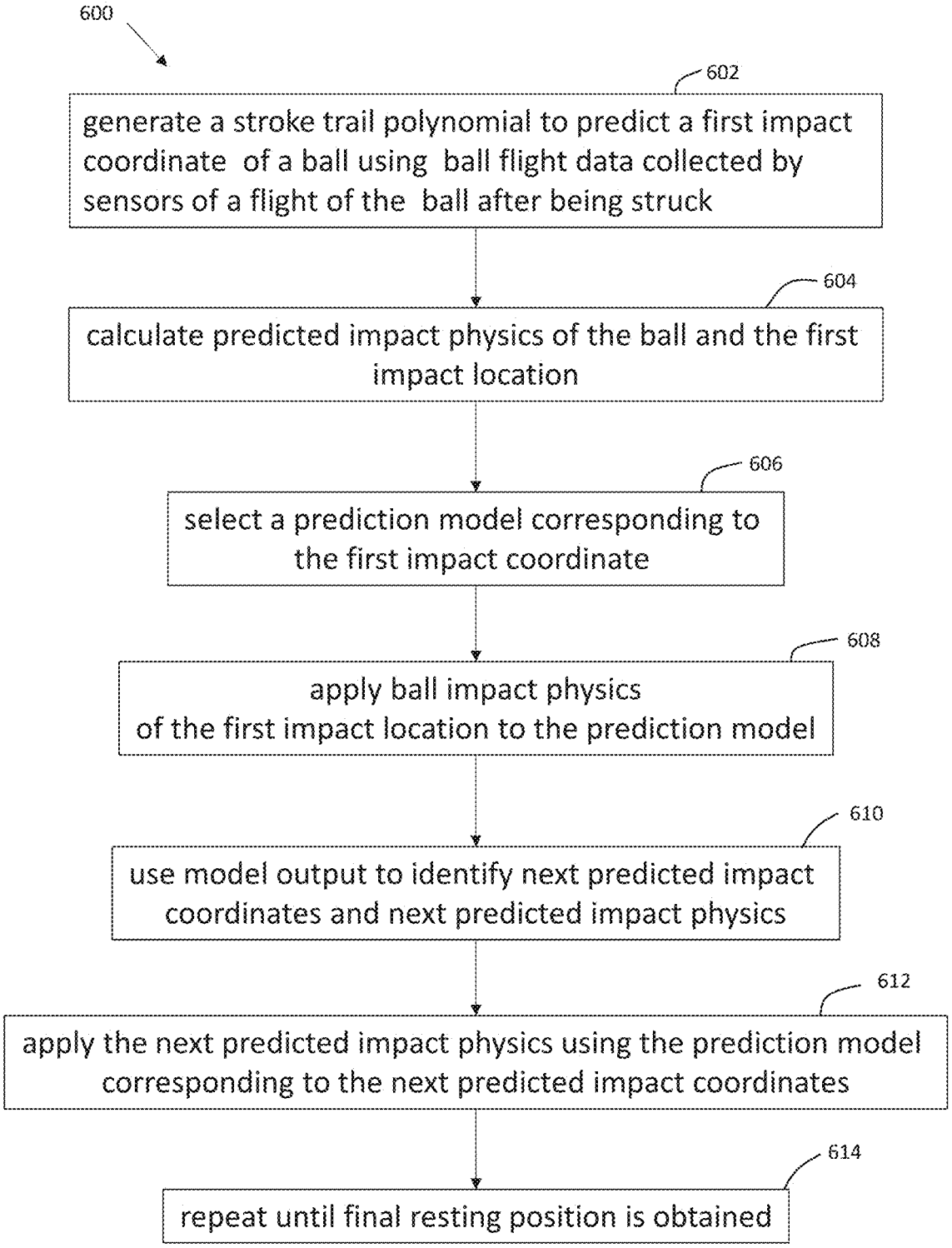
FIG. 6 illustrates operations for determining a final impact location according to various embodiments described herein.
Figure 7:
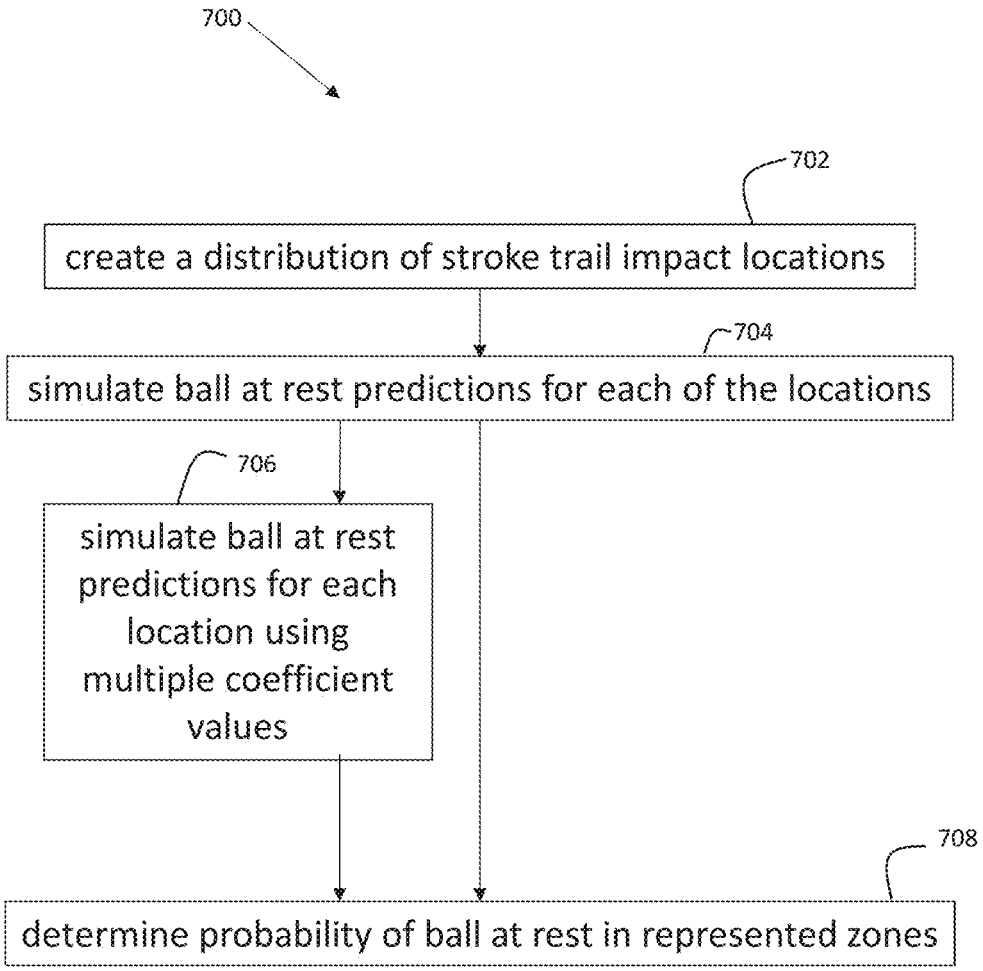
FIG. 7 illustrates operations for generating a zone probability according to various embodiments described herein.

FIG. 6 illustrates an embodiment of operations 600 of the system 10 according to various embodiments. The flight simulator 22 may be configured to generate a stroke trail polynomial to predict a first impact coordinate of a ball using ball flight data collected by sensors of the flight tracking network 14 corresponding to flight of the ball after being struck 602. In one example, the flight simulator 22 may be configured to calculate predicted impact physics of the ball and the first impact location 604. It is further noted that in some embodiments, the flight simulator 22 may generate a stroke trail polynomial from ball flight data collected by sensors of the ball tracking network 14 corresponding to flight of the ball after being struck and obtain or calculate impact physics of the ball and the first impact location. A prediction model 20 corresponding to the first impact coordinate may be selected 606. The prediction model 20 may be associated with a zone encompassing the impact coordinate. The physics simulator 24 may apply ball impact physics of the first impact location to the prediction model 608. The model output may be used to identify a next predicted impact coordinates and next predicted impact physics 610. Using the prediction model corresponding to the next predicted impact coordinates, the next impact physics may be used to calculate a next predicted impact location and physics 612. This operation may be repeated until final resting position is obtained 614. In some embodiments, surface topography corresponding to the impact coordinates may also be used with respect to the prediction models 20. In one example, prediction models 20 may be used to model bounce and roll as described herein. In the above or another example, the prediction models 20 may include coefficients incorporating stimp, firmness or both with respect to the surfaces the ball impacts or rolls. In any of the above or another example, the physics simulator 24 or update engine 26 utilizes a surface model that includes the course and surrounding area to extract surface features for use in the prediction models 20. In any of the above or another example, environmental data collected by environmental sensors relevant to the ball flight of the ball may be incorporated into the predicted impact locations. These environmental data may include, for example, wind speed, wind speed and direction, humidity, altitude, or any combination thereof. In any of the above or a another example, actual final resting positions may be compared to predicted final resting position for a sliding window of historical shots. The coefficients resulting in the least amount of error between actual and predicted resting position may be selected as a current optimal coefficient, as described elsewhere herein. In one instance, the coefficient comprises a firmness coefficient. In any of the above or another example, the update engine 26 may be update one or more coefficients of a prediction model 10 including coordinates subject to changed environmental conditions based on historical impact of the changed conditions on bounce, roll, final resting position, or combination thereof. In any of the above or another example, as described in more detail elsewhere herein, the physics simulator 24 may generate a zone probability with respect to final resting positions comprising creating a distribution of locations around the predicted first impact location, each with a probability of occurrence, and simulating ball at rest predictions for each of the locations using multiple levels of one or more coefficients. In one example, the one or more coefficients is a firmness coefficient.

As introduced above, in some embodiments, the update engine 24 may be configured to dynamically calibrate one or more prediction model 20 coefficients. These may include firmness or stimp, for example. In one example, the update engine 26 is configured to calculate an optimum firmness coefficient. The update engine 26 may apply a set of various firmness combinations to a set of historical shots in which actual data is known, e.g., from the historical shot database 28. The update engine 26 may loop through the set of different firmness combinations, e.g., 10 different firmness combinations, to find which one results in the least amount of average error for the set of historical shots. In one example, the update engine 26 is configured to dynamically calibrate firmness coefficients and the update engine 26 applies a sliding window of previous historical shots, such as described herein, to identify which firmness coefficient produces the least amount of error and update the prediction model accordingly for use in the next shot. In one configuration, for each zone, the prediction models 20 use a dynamic firmness coefficient and static stimp coefficient for the physics simulations. While stimp-style data can be used to dynamically inform the prediction model 20 and produce a predicted coordinate, the stimp data may also be used to demonstrate a measured firmness or stimp reading based on measured factors such as bounce height as measured by ball tracking network sensors placed on or around the golf course. In one embodiment, the amount of prediction error is calculated by taking the distance difference between a final resting measurement of the ball and the predicted ball at rest. This may be used by the update engine 26 to adjust firmness coefficients in the prediction model. This may be performed prior to play using shot data from similar zones or similar zone conditions and similar shots expected to be hit in the zone. In one example, the historical shot data is from the same hole and zone. In one example, the update engine 26 generates an optimal firmness coefficient during play and the historical shot data is that of shots into the zone during play. In another embodiment, the prediction models 20 initially use medium or expected coefficient values for the conditions and ground materials in the zone.

In various embodiments, the prediction generator 16 is configured to generate a zone probability of the predicted ball at rest. In one embodiment, the prediction generator is configured to generate a stroke trail polynomial to identify or predict a first impact coordinate of a ball using ball flight data collected by the ball tracking network 14 after being struck. The final resting position may be calculated as described anywhere herein. With reference to operation 700 depicted in FIG. 7, the prediction generator 16 or another system configured to generate predictions may be configured to create a distribution of stroke trail impact locations 702 and simulate ball at rest predictions for each of the locations 703. In one configuration, the ball at rest positions may be simulated for each location using multiple coefficient values 704. For example, the physics simulator 24 may create a distribution of locations around the stroke trail's impact location, each with a probability of occurrence, and simulate ball at rest predictions for each of these locations, using multiple firmness coefficient levels. For instance, the firmness levels may include a current, slightly softer, and slightly firmer coefficient. The prediction generator 16 may aggregate and sum the results to determine the probability of outcome of each zone. For example, the physics simulator 24 may run multiple, e.g., hundreds, of simulated shots with known parameters and variances and determine the proportion of shots that rest in each potential zone, e.g., fairway, rough, bunker, or water. For example, the prediction generator 16 may use the most probable impact location with respect to final resting position predictions and the corresponding zone. However, other impact locations may also be identified that have associated probabilities. The prediction generator 16 may similarly use these impact position in the methods described herein to calculate a distribution of prediction resting positions, zone probabilities, or both. For example, a ball predicted to travel through a tree may result in a large distribution of predicted first impact locations. The physics simulator 26 may calculate bounce and roll for each predicted impact location to generate a distribution of final resting positions. The number and associated probabilities of balls resting in the potential zones may be calculated to generate probabilities for each zone. This may be performed even when a large distribution in predicted first impact position in not present. Additionally or alternatively, the physics simulator 26 may modify one or more coefficient levels to generate modified resting positions. The modified coefficient may be modified within a range slightly above and slightly below a current optimal value, e.g., 1% to 10%. The bounce and roll and final resting positions may be modeled using the current and slightly modified values to generate the probability distribution corresponding the representative number of runs that are predicted to come to rest in the potential zones. In some embodiments, probabilities associated with each of the specific runs may be further included in the zone probability calculation. The zone and probabilities may be transmitted to data clients, television broadcasts, scoring systems, spotters, betting platforms, or for other uses, such as any described herein. As described below, predictions may be updated with further predictions based on additional collected data, actual final collected data, or both.

Further to the above, the system 10 may use sensor data stroke trail polynomial to calculate the predicted resting location of a ball by simulating the bounce and roll from the location of the trail's impact with a surface or before the ball impact with the surface. The prediction data, e.g., bounce and roll behavior, zone probability, resting position, or combination thereof, may be utilized to project ball locations for enriching television broadcasts, data clients for downstream applications, or for integration in manual or automated scoring as well as other internal applications. In various embodiments, the data may be used to inform downstream sensors of probabilistic locations to search for next shot hit and other golf-related information. For example, the data may be provided to manual or automated scoring sensors to identify probabilistic location to search for next shot or where to locate a ball for actual location for historical data tracking purposes, confirmation of location and zone, or for the ball tracking network to track next shot. In any of the above or another embodiment, the data may be utilized to inform downstream clients of shot location that will inform elements such as odds prediction for betting, visual inputs such as stroke trails for television or digital broadcast and other digital representations such as showing margins of likely shot inputs in video-game like representations of play. For example, the coordinates and generated predicted ball behavior within the coordinate system may be directly translated in to an animated environment. This digitally enriched presentation may illustrate various probabilistic outcomes based on behavior and location probabilities generated by the prediction generator. In any of the above or another embodiment, the data may be provided to alert staff when balls may land outside the range of other sensors so additional data may be collected by other means, e.g., a spotter may then know where to find the ball so it can be shot with a mobile laser to identify the balls actual position.

As introduced above, predicted shot locations from the calculations above may be used by a scoring system in an automated scoring environment, which may be used in combination with spotters, using on-course sensors to determine or confirm final coordinates. For instance, predicted coordinates or zones may be provided to cameras or lasers to identify a ball at rest and confirm location of the ball for scoring purposes. This or the predicted coordinates or zones may be provided to other sensors such as radar for tracking a next shot. In one embodiment, if a shot is predicted to be at a specific location and a spotter, using equipment on the ground, may be able to quickly validate coordinates through any location mapping system that the predicted shot is within a given tolerance (e.g. 95%), that coordinate may be automatically marked as final in a scoring system. In one embodiment, the scoring system may be configured to mark shot locations or zones as final if the predicted coordinates are a threshold distance from another zone or other predetermined tolerance. For example, in cases where a coordinate is predicted to be outside of a given predetermined tolerance, e.g. less than two standard deviations, the system may automatically mark a shot as final. For instance, if a shot is predicted to be far enough into a water hazard that the distance from the edge is more than two standard deviations, that shot would automatically be marked as final. Coordinates may be used to confirm balls associated with players as corresponding to balls previously tracked by sensors of a ball tracking network used by the scoring system. In one embodiment, the sensors, for example, may track balls that the system tracks as associated with a particular player. The scoring system may also utilize the sensors to identify players, e.g., via a gait or clothing. In some embodiments, players may be associated with markers that may be tracked by sensors, e.g., IR markers, thermal markers, or other optical markers. Players may wear location tracking devices that may be tracked and coordinates supplied to sensors to enhance ball tracking. Coordinates or zone predictions may be used to confirm the association of a ball with a player or a prior shot to enhance tracking and validate scoring.

As introduced above, the data may be utilized to inform downstream clients of shot location that will inform elements such as odds prediction for betting. Using the present system and methods, odds can be predicted before human intervention, for example with predicted coordinate produced beginning at the measured apex of a shot given. Using the available sensory input thereafter together with updating of the predicted coordinate based on further ball flight data collection a measure of confidence converges to 100% as the ball track moves forward. This methodology may be used to enable odds production at various points within the predictive window prior to any human having knowledge of a shot and lead to improved automated sports betting.

The system and methods may find use in applications beyond golf. For example, the system and methods may be used to estimate ballistic outcomes for artillery projectiles based on detailed mapping locations. For example, in a paintball match, large projectiles could be aimed and used by one team to shoot around or bounce off objects for scoring success. Thus, the systems and methods may be implemented in an aiming system.

The systems and methods disclosed herein may include still further functionalities and features. For example, the operative functions of the system 10 and method may be configured to execute on a special-purpose processor specifically configured to carry out the operations provided by the system and method. Notably, the operative features and functionality provided by the system and method may increase the efficiency of computing devices that are being utilized to facilitate the functionality provided by the system and the various methods disclosed herein. For example, by training the system over time based on data and/or other information provided and/or generated in the system 10, a reduced amount of computer operations may need to be performed by the devices and elements in the system 10 using the processors and memories of the system 10 than compared to traditional methodologies. In such a context, less processing power needs to be utilized because the processors and memories do not need to be dedicated for processing. As a result, there are substantial savings in the usage of computer resources by utilizing the software, techniques, and algorithms provided in the present disclosure. In certain embodiments, various operative functionality of the system 10 may be configured to execute on one or more graphics processors and/or application specific integrated processors. In some embodiments, various functions and features of the system 10 and methods may operate without any human intervention and may be conducted entirely by computing devices. In certain embodiments, for example, numerous computing devices may interact with devices of the system 10 to provide the functionality supported by the system 10. Additionally, in certain embodiments, the computing devices of the system 10 may operate continuously and without human intervention to reduce the possibility of errors being introduced into the system 10.

Figure 8:
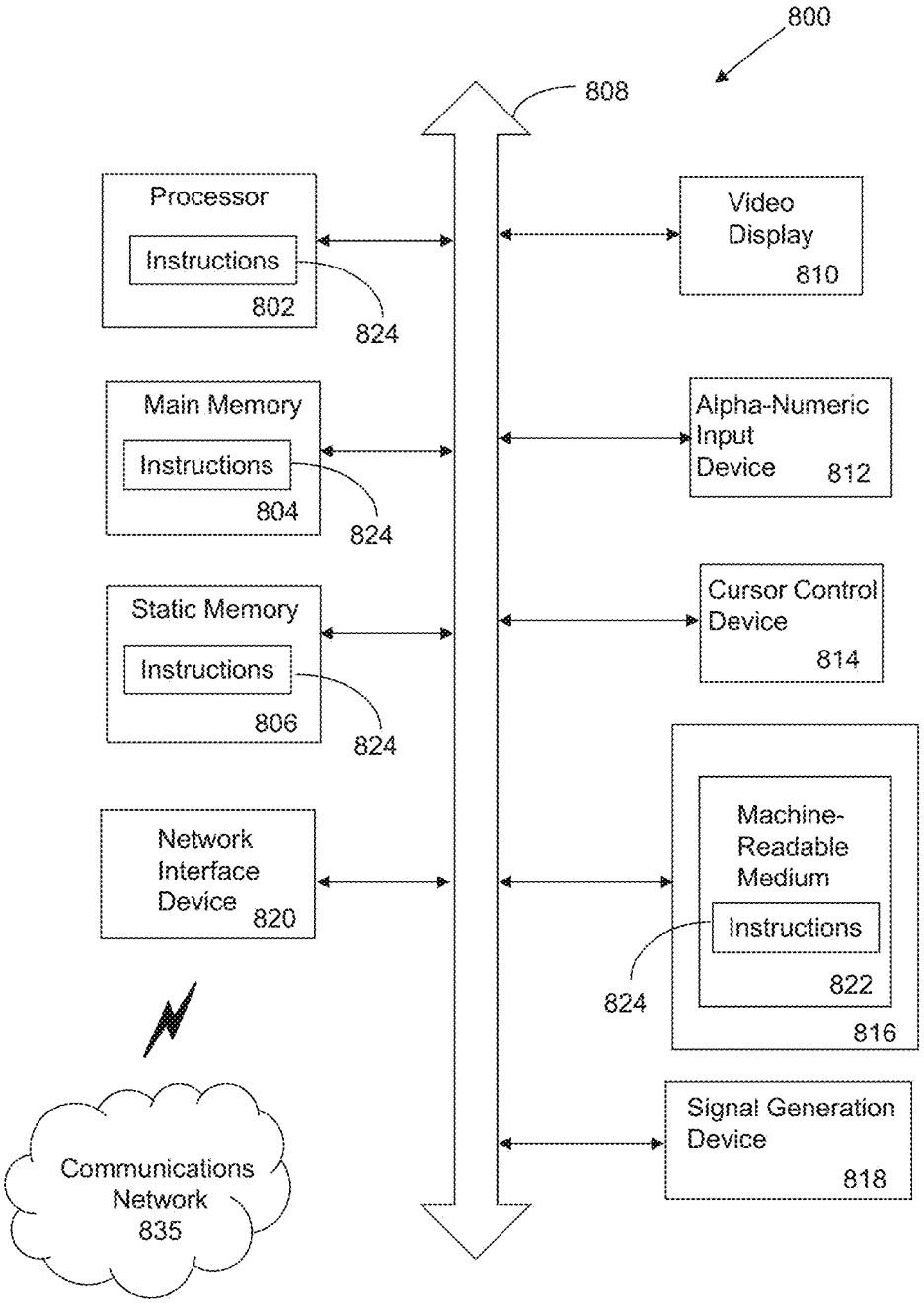
FIG. 8 is a schematic diagram of a machine in the form of a computer system within which a set of instructions, when executed, may cause the machine perform simulation modeling to generation predictive outcomes and probabilities thereof according to various embodiments described herein.

Referring now also to FIG. 8, at least a portion of the methodologies and techniques described with respect to the exemplary embodiments of the system 10 can incorporate a machine, such as, but not limited to, computer system 800, or other computing device within which a set of instructions, when executed, may cause the machine to perform any one or more of the methodologies or functions discussed above. The machine may be configured to facilitate various operations conducted by the system 10. For example, the machine may be configured to, but is not limited to, assist the system 10 by providing processing power to assist with processing loads experienced in the system 10, by providing storage capacity for storing instructions or data traversing the system 10, or by assisting with any other operations conducted by or within the system 10. As another example, the computer system 800 may assist with generating models associated with generating predictions, ball tracking, data collection, data importation, data storage, data processing, mapping, updates to any thereof, or a combination thereof, present in an environment being monitored by the system 10. As another example, the computer system 800 may assist in generating zone probability distributions. As another example, the computer system 800 may assist with output, distribution, or both of predictions or updates to television broadcast, streaming broadcasts, digital platforms for viewing, manipulating, formatting, or combination thereof of the same.

In some embodiments, the machine may operate as a standalone device. In some embodiments, the machine may be connected to and assist with operations performed by other machines and systems, such as, but not limited to, any functionality, generator, simulator, database, engine, of other functionality described herein, any of which may be provided by such other machines or systems to the machine for use by system 10 in performance of the operations described herein. The machine may be connected with any component in the system 10. In a networked deployment, the machine may operate in the capacity of a server or a client user machine in a server-client user network environment, or as a peer machine in a peer-to-peer (or distributed) network environment. The machine may comprise a server computer, a client user computer, a personal computer (PC), a tablet PC, a laptop computer, a desktop computer, a control system, a network router, switch or bridge, or any machine capable of executing a set of instructions (sequential or otherwise) that specify actions to be taken by that machine. Further, while a single machine is illustrated, the term "machine" shall also be taken to include any collection of machines that individually or jointly execute a set (or multiple sets) of instructions to perform any one or more of the methodologies discussed herein.

The computer system 800 may include a processor 802 (e.g., a central processing unit (CPU), a graphics processing unit (GPU, or both), a main memory 804 and a static memory 806, which communicate with each other via a bus 808. The computer system 800 may further include a video display unit 810, which may be, but is not limited to, a liquid crystal display (LCD), a flat panel, a solid state display, or a cathode ray tube (CRT). The computer system 800 may include an input device 812, such as, but not limited to, a keyboard, a cursor control device 814, such as, but not limited to, a mouse, a disk drive unit 816, a signal generation device 818, such as, but not limited to, a speaker or remote control, and a network interface device 820. The network interface device 835 may handle data communications for other devices, units, or components of the system 10 or another system or machine. For example, sensors of the ball tracking network 14, environmental sensors 17, or both may communicate collected data with the system 10 via the communication network 835.

The disk drive unit 816 may include a machine-readable medium 822 on which is stored one or more sets of instructions 824, such as, but not limited to, software embodying any one or more of the methodologies or functions described herein, including those methods illustrated above. The instructions 824 may also reside, completely or at least partially, within the main memory 804, the static memory 806, or within the processor 802, or a combination thereof, during execution thereof by the computer system 800. The main memory 804 and the processor 802 also may constitute machine-readable media.

Dedicated hardware implementations including, but not limited to, application specific integrated circuits, programmable logic arrays and other hardware devices can likewise be constructed to implement the methods described herein. Applications that may include the apparatus and systems of various embodiments broadly include a variety of electronic and computer systems. Some embodiments implement functions in two or more specific interconnected hardware modules or devices with related control and data signals communicated between and through the modules, or as portions of an application-specific integrated circuit. Thus, the example system is applicable to software, firmware, and hardware implementations.

In accordance with various embodiments of the present disclosure, methods described herein are intended for operation as software programs running on a computer processor. Furthermore, software implementations can include, but not limited to, distributed processing or component/object distributed processing, parallel processing, or virtual machine processing can also be constructed to implement the methods described herein.

The present disclosure contemplates a machine-readable medium 822 containing instructions 824 so that a device connected to the communications network 835, another network, or a combination thereof, can send or receive voice, video or data, and communicate over the communications network 835, another network, or a combination thereof, using the instructions. The instructions 824 may further be transmitted or received over the communications network 835, another network, or a combination thereof, via the network interface device 820.

While the machine-readable medium 822 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding or carrying a set of instructions for execution by the machine and that causes the machine to perform any one or more of the methodologies of the present disclosure.

The terms "machine-readable medium," "machine-readable device," or "computer-readable device" shall accordingly be taken to include, but not be limited to: memory devices, solid-state memories such as a memory card or other package that houses one or more read-only (non-volatile) memories, random access memories, or other re-writable (volatile) memories; magneto-optical or optical medium such as a disk or tape; or other self-contained information archive or set of archives is considered a distribution medium equivalent to a tangible storage medium. The "machine-readable medium," "machine-readable device," or "computer-readable device" may be non-transitory, and, in certain embodiments, may not include a wave or signal per se. Accordingly, the disclosure is considered to include any one or more of a machine-readable medium or a distribution medium, as listed herein and including art-recognized equivalents and successor media, in which the software implementations herein are stored.

The illustrations of arrangements described herein are intended to provide a general understanding of the structure of various embodiments, and they are not intended to serve as a complete description of all the elements and features of apparatus and systems that might make use of the structures described herein. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Thus, although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description. Therefore, it is intended that the disclosure not be limited to the particular arrangement(s) disclosed as the best mode contemplated for carrying out this invention, but that the invention will include all embodiments and arrangements falling within the scope of the appended claims.

The foregoing is provided for purposes of illustrating, explaining, and describing embodiments of this invention. Modifications and adaptations to these embodiments will be apparent to those skilled in the art and may be made without departing from the scope or spirit of this invention. Upon reviewing the aforementioned embodiments, it would be evident to an artisan with ordinary skill in the art that said embodiments can be modified, reduced, or enhanced without departing from the scope and spirit of the claims described below.

What is claimed is:

1. A system for predicting a resting position of a golf ball, the system comprising:

a processor and memory storing instructions that when executed by the processor cause the system to perform operations of the system;

a ball tracking network comprising a plurality of sensors positioned around a golf course to collect ball flight data of balls after being struck, the sensors comprising cameras, radar devices, laser devices, or combination thereof;

a flight simulator configured to:

use the ball flight data collected by the ball tracking network to predict a first impact location and impact physics of a ball after being struck; and identify a coordinate within a coordinate space defined with respect to the course or surrounding area that corresponds to the predicted first impact location;

a physics simulator configured to:

select a first prediction model from a plurality of prediction models that corresponds to the predicted first impact coordinate, and apply the predicted first impact physics and a surface topography of the predicted first impact location to the first prediction model to predict a second impact location and corresponding second impact coordinate and second impact physics, wherein each of the plurality of prediction models correspond to one or more of the coordinates defined with respect to the course or surrounding area; and select a second prediction model from the plurality of prediction models that corresponds to the predicted second impact coordinate, apply the predicted second impact physics and a surface topography corresponding to the predicted second impact location to the second prediction model to predict a next impact coordinate and impact physics, and repeating until a final resting position is generated; and an update engine configured to compare predicted final resting positions generated for multiple struck balls to actual final resting positions for the multiple struck balls for a sliding window of historical shots, and update one or more coefficients of the prediction models that result in the least amount of error between predicted and final resting positions.

2. The system of claim 1, wherein a surface material coefficient corresponding to one or more of the impact coordinates is incorporated into the respective prediction model.

3. The system of claim 1, wherein the prediction models are configured to model applicable bounce and roll behavior of the ball to the final resting position.

4. The system of claim 1, wherein one or more of the prediction models includes coefficients incorporating stimp, firmness, or both with respect to a surface of the course or surrounding area at the one or more coordinates the prediction model corresponds.

5. The system of claim 1, wherein the surface topography is obtained from a surface model that includes surface features of the course and surrounding area.

6. The system of claim 5, wherein the system is further configured to import object surface models from a surface model library of objects into the surface model.

7. The system of claim 1, wherein the one or more coefficients updated by the update engine comprise a firmness coefficient.

8. The system of claim 1, wherein the system further includes environmental sensors configured to detect environmental conditions and an update engine configured to update a coefficient of one or more prediction models due to a detected changed environmental condition based on historical impact of the changed condition on bounce, roll, final resting position, or combination thereof.

9. A system for predicting a resting position of a golf ball, the system comprising:

a processor and memory storing instructions that when executed by the processor cause the system to perform operations, the operations comprising:

generating, with a flight simulator, a stroke trail polynomial of a flight of a ball after being struck using ball flight data collected by a sensors of a ball tracking network;

predicting, with the flight simulator, a coordinate of a first impact location of the ball using the stroke trail polynomial relative to a coordinate map of the course;

calculating, with the flight simulator, predicted impact physics of the ball using the stroke trail polynomial;

selecting, with a physics simulator, a prediction model corresponding to a zone containing the first impact coordinate;

inputting, with the physics simulator, the impact physics into the prediction model to identify a next predicted impact coordinate, next predicted impact physics, a prediction model corresponding to the next predicted impact coordinate to input the next predicted impact physics, and repeating to generate a predicted final resting position before actual impact of the ball, wherein the prediction model includes coefficients that incorporate surface properties of materials at coordinates the ball is predicted to impact, and wherein the coefficients include stimp, firmness, or both; and comparing, with an update engine, predicted final resting positions generated for multiple struck balls to actual resting position for the multiple struck balls for a sliding window of historical shots, and updating one or more coefficients of the prediction models that result in the least amount of error between the predicted and actual final resting position.

10. The system of claim 9, wherein the operations further comprise obtaining surface feature data corresponding to one or more impact locations from a surface model of the course and inputting the surface feature data into the corresponding prediction model.

11. The system of claim 10, wherein the surface feature data includes surface topography.

12. The system of claim 10, wherein the surface model includes the course and surrounding area.

13. The system of claim 10, wherein the system is further configured to incorporate object surface models corresponding to objects on the course or surrounding area from a surface model library of objects into the surface model.

14. The system of claim 9, wherein the prediction models are configured to model applicable bounce and roll behavior of the ball to the final resting position.

15. The system of claim 9, wherein the flight simulator is further configured to incorporate actual environmental data at the time the ball is struck relevant to the ball flight of the ball when predicting the coordinate of the first impact location.

16. The system of claim 15, wherein the environmental data comprises wind speed and wind direction.

17. The system of claim 15, wherein the environmental data comprises humidity, altitude, or both.

18. The system of claim 9, wherein the one or more coefficients updated by the update engine comprise a firmness coefficient.

19. The system of claim 9, wherein the update engine is further configured to update a coefficient of one or more of the prediction models due to a detected changed environmental condition on or around the course based on historical impact of the changed condition on bounce, roll, final resting position, or combination thereof.

20. The system of claim 9, wherein the operations further include generating a zone probability with respect to the final resting position comprising creating a distribution of locations around the predicted first impact location, each with a probability of occurrence, and simulating ball at rest predictions for each of the locations using multiple levels of one or more coefficients.

21. The system of claim 20, wherein the one or more coefficients comprise a firmness coefficient, and the levels include a current firmness coefficient, a smaller firmness coefficient, and a firmness larger coefficient.

22. A system for predicting a resting position of a golf ball, the system comprising:

a processor and memory storing instructions that when executed by the processor cause the system to perform operations of the system;

a ball tracking network comprising a plurality of sensors positioned around a golf course to collect ball flight data of balls after being struck, the sensors comprising cameras, radar devices, laser devices, or combination thereof;

a flight simulator configured to predict coordinates of a first impact location and impact physics of a ball after being struck using the ball flight data; and a physics simulator configured to select from a plurality of prediction models first prediction model corresponding to a zone containing the first impact coordinate, input the predicted impact physics into the first prediction model to identify a next predicted impact coordinate and next predicted impact physics, and repeat to model bounce and roll of the ball from the predicted first impact coordinate and obtain a predicted first final resting position, wherein the predictions models include coefficients that incorporate surface properties of materials in zones the prediction models correspond, and wherein the coefficients include stimp, firmness, or both, wherein the physics simulator is further configured to generate a distribution with respect to the final resting position by modifying the respective prediction models to include one or more coefficient values that are greater and less than the respective current value used to generate the predicted first final resting position and using the modified prediction models to model bounce and roll from the predicted first impact coordinate to generate a distribution of final resting positions.

23. A system for predicting a resting position of a golf ball, the system comprising:

a memory stores instructions; and a processor that executes the instructions to perform operations, the operations comprising:

generating, with a flight simulator, a stroke trail polynomial from ball flight data collected by sensors of a ball tracking network corresponding to flight of a ball after being struck;

obtaining or predicting, with the flight simulator, a predicted first impact location and first impact physics of the ball;

applying, with a physics simulator, the predicted first impact physics to a prediction model comprising coefficients incorporating properties of surface material in a zone encompassing coordinates that include the predicted first impact location and modeling bounce and roll behavior of the ball from the predicted first impact location to a final resting position; and generating, with the physics simulator, before actual impact of the ball, a zone probability with respect to the predicted final resting position comprising creating a distribution of additional predicted first impact locations around the predicted first impact location, each with a probability of occurrence, and simulating final resting position predictions for each of the locations using multiple levels of one or more coefficients in the respective prediction model to obtain a distribution of final resting positions and corresponding zones encompassing the final resting positions to provide the zone probability.

24. The system of claim 23, wherein the physics simulator is further configured to generate a zone probability distribution corresponding to the representative number of predicted final resting positions in the distribution predicted to be within represented zones encompassing the predicted final resting positions.

* * * * *